US009752770B2

(12) United States Patent
Kim et al.

(10) Patent No.: US 9,752,770 B2
(45) Date of Patent: Sep. 5, 2017

(54) LIGHT-EMITTING DIODE LIGHT FIXTURE WITH CHANNEL-TYPE HEAT DISSIPATION SYSTEM

(71) Applicant: KOREA INSTITUTE OF SCIENCE AND TECHNOLOGY, Seoul (KR)

(72) Inventors: Sang Woo Kim, Seoul (KR); Byung Hyuk Kim, Seoul (KR); Dae Hwan Kwon, Seoul (KR)

(73) Assignee: KOREA INSTITUTE OF SCIENCE AND TECHNOLOGY, Seoul (KR)

( * ) Notice: Subject to any disclaimer, the term of this patent is extended or adjusted under 35 U.S.C. 154(b) by 216 days.

(21) Appl. No.: 14/645,940

(22) Filed: Mar. 12, 2015

(65) Prior Publication Data

US 2015/0276201 A1 Oct. 1, 2015

(30) Foreign Application Priority Data

Mar. 28, 2014 (KR) ..... 10-2014-0037249

(51) Int. Cl.
*F21V 29/83* (2015.01)
*F21V 29/75* (2015.01)
(Continued)

(52) U.S. Cl.
CPC ..... *F21V 29/83* (2015.01); *F21V 29/75* (2015.01); *F21V 29/80* (2015.01); *F21Y 2105/10* (2016.08); *F21Y 2115/10* (2016.08)

(58) Field of Classification Search
CPC ..... F21V 29/70; F21V 29/75; F21V 29/763; F21V 29/77; F21V 29/773; F21V 29/83;
(Continued)

(56) References Cited

U.S. PATENT DOCUMENTS 4,558,735 A * 12/1985 Meike ..... B23K 11/0046 165/131
2007/0230185 A1* 10/2007 Shuy ..... B60Q 1/20 362/294
(Continued)

FOREIGN PATENT DOCUMENTS

KR 20010035209 A 5/2001
KR 101040722 B1 6/2011
(Continued)

OTHER PUBLICATIONS

Korean Office Action dated Oct. 21, 2015; Appln. No. 10-2014-0037249.

*Primary Examiner* — Anh Mai
*Assistant Examiner* — Steven Horikoshi
(74) *Attorney, Agent, or Firm* — Ladas & Parry LLP; Loren K. Thompson

(57) ABSTRACT

A light-emitting diode (LED) light fixture with a channel-type heat dissipation system is provided. The LED light fixture includes a plurality of light-emitting devices including LEDs, a heat dissipation unit connected with the plurality of light-emitting devices and having the plurality of light-emitting devices mounted thereon, a casing accommodating the heat dissipation unit and the light emitting devices, a cover connected with the casing, disposed above the plurality of light-emitting devices, and that is light-transmissive, and a ventilation channel through which ambient air passes. The casing has one open surface. The cover is connected to cover the open surface. The heat dissipation unit has an upper surface exposed through the open surface and a lower surface. The plurality of light-emitting devices are connected to the upper surface of the heat dissipation unit and exposed through the open surface.

4 Claims, 27 Drawing Sheets

(51) Int. Cl.
*F21V 29/80* (2015.01)
*F21Y 105/10* (2016.01)
*F21Y 115/10* (2016.01)

(58) Field of Classification Search
CPC ..... F21V 29/2212; F28F 3/025; F28F 3/027; F28F 3/046
See application file for complete search history.

(56) References Cited

U.S. PATENT DOCUMENTS

2008/0055908 A1* 3/2008 Wu ..... F21S 2/005 362/294
2009/0230833 A1* 9/2009 Kao ..... F21V 29/70 313/1
2009/0316404 A1* 12/2009 Mo ..... F21S 8/086 362/249.01
2009/0323361 A1* 12/2009 Liu ..... F21V 29/02 362/373
2010/0109499 A1* 5/2010 Vilgiate ..... F21V 3/00 313/1
2011/0286200 A1* 11/2011 Iimura ..... F21V 7/041 362/84
2012/0113634 A1* 5/2012 Wong ..... F21V 21/005 362/235
2012/0161602 A1* 6/2012 Yu ..... F21V 29/02 313/46
2013/0294094 A1 11/2013 Horng
2014/0177231 A1* 6/2014 Nakamura ..... F21V 13/04 362/308

FOREIGN PATENT DOCUMENTS

KR 1020110098085 A 9/2011
KR 20120055718 A 5/2012
KR 1020130123623 A 11/2013
KR 101367757 B1 2/2014

* cited by examiner

FIG. 16

| NO | LED UNIT POWER [W] | TOTAL POWER [W] | ΔT [℃] | | | |
|---|---|---|---|---|---|---|
| | | | 3 cm | 4 cm | 5 cm | 6 cm |
| 1 | 2 | 52 | EMBODIMENT 1 | EMBODIMENT 11 | EMBODIMENT 21 | EMBODIMENT 31 |
| 2 | 3 | 78 | EMBODIMENT 2 | EMBODIMENT 12 | EMBODIMENT 22 | EMBODIMENT 32 |
| 3 | 4 | 104 | EMBODIMENT 3 | EMBODIMENT 13 | EMBODIMENT 23 | EMBODIMENT 33 |
| 4 | 4.65 | 120.9 | EMBODIMENT 4 | EMBODIMENT 14 | EMBODIMENT 24 | EMBODIMENT 34 |
| 5 | 5 | 130 | EMBODIMENT 5 | EMBODIMENT 15 | EMBODIMENT 25 | EMBODIMENT 35 |
| 6 | 6 | 156 | EMBODIMENT 6 | EMBODIMENT 16 | EMBODIMENT 26 | EMBODIMENT 36 |
| 7 | 7 | 182 | EMBODIMENT 7 | EMBODIMENT 17 | EMBODIMENT 27 | EMBODIMENT 37 |
| 8 | 8 | 208 | EMBODIMENT 8 | EMBODIMENT 18 | EMBODIMENT 28 | EMBODIMENT 38 |
| 9 | 9 | 234 | EMBODIMENT 9 | EMBODIMENT 19 | EMBODIMENT 29 | EMBODIMENT 39 |
| 10 | 10 | 260 | EMBODIMENT 10 | EMBODIMENT 20 | EMBODIMENT 30 | EMBODIMENT 40 |

FIG. 17

| NO | LED UNIT POWER [W] | TOTAL POWER [W] | ΔT [℃] | | | |
|---|---|---|---|---|---|---|
| | | | 3 cm | 4 cm | 5 cm | 6 cm |
| 1 | 2 | 52 | 32.1 | 32.1 | 32.1 | 32.1 |
| 2 | 3 | 78 | 49.1 | 49.1 | 49.1 | 49.1 |
| 3 | 4 | 104 | 54 | 54 | 54 | 54 |
| 4 | 4.65 | 120.9 | 61 | 61 | 61 | 61 |
| 5 | 5 | 130 | 64.7 | 64.7 | 64.7 | 64.7 |
| 6 | 6 | 156 | 75 | 75 | 75 | 75 |
| 7 | 7 | 182 | 84.9 | 84.9 | 84.9 | 84.9 |
| 8 | 8 | 208 | 94.4 | 94.4 | 94.4 | 94.4 |
| 9 | 9 | 234 | 103.5 | 103.5 | 103.5 | 103.5 |
| 10 | 10 | 260 | 112.3 | 112.3 | 112.3 | 112.3 |

FIG. 19

| NO | CHANNEL HEIGHT | 120W_4 | | 150W_4 | |
|---|---|---|---|---|---|
| | [cm] | 205 W/mK | 100 W/mK | 205 W/mK | 100 W/mK |
| 11 | 3 | EMBODIMENT 41 | EMBODIMENT 46 | EMBODIMENT 51 | EMBODIMENT 56 |
| 12 | 4 | EMBODIMENT 42 | EMBODIMENT 47 | EMBODIMENT 52 | EMBODIMENT 57 |
| 13 | 5 | EMBODIMENT 43 | EMBODIMENT 48 | EMBODIMENT 53 | EMBODIMENT 58 |
| 14 | 6 | EMBODIMENT 44 | EMBODIMENT 49 | EMBODIMENT 54 | EMBODIMENT 59 |
| 15 | 7 | EMBODIMENT 45 | EMBODIMENT 50 | EMBODIMENT 55 | EMBODIMENT 60 |

FIG. 20

| NO | CHANNEL HEIGHT | 120W_4 | | 150W_4 | |
|---|---|---|---|---|---|
| | [cm] | 205 W/mK | 100 W/mK | 205 W/mK | 100 W/mK |
| 11 | 3 | 59.9 | 65.1 | 64.7 | 71.4 |
| 12 | 4 | 56.7 | 61.9 | 61.5 | 68.2 |
| 13 | 5 | 54.3 | 59.4 | 59 | 68 |
| 14 | 6 | 52.6 | 57.6 | 57.1 | 67.8 |
| 15 | 7 | 51.3 | 56.3 | 55.6 | 66.5 |

FIG. 22

| NO | LED UNIT POWER [W] | TOTAL POWER [W] | CHANNEL STRUCTURE | | PLATE/PIN COMBINATION STRUCTURE | |
|---|---|---|---|---|---|---|
| | | | MULTIPLE ARRAY | SINGLE ARRAY | MULTIPLE ARRAY | SINGLE ARRAY |
| 16 | 2 | 52 | EMBODIMENT 61 | EMBODIMENT 71 | COMPARATIVE EXAMPLE 1 | COMPARATIVE EXAMPLE 11 |
| 17 | 3 | 78 | EMBODIMENT 62 | EMBODIMENT 72 | COMPARATIVE EXAMPLE 2 | COMPARATIVE EXAMPLE 12 |
| 18 | 4 | 104 | EMBODIMENT 63 | EMBODIMENT 73 | COMPARATIVE EXAMPLE 3 | COMPARATIVE EXAMPLE 13 |
| 19 | 4.65 | 120.9 | EMBODIMENT 64 | EMBODIMENT 74 | COMPARATIVE EXAMPLE 4 | COMPARATIVE EXAMPLE 14 |
| 20 | 5 | 130 | EMBODIMENT 65 | EMBODIMENT 75 | COMPARATIVE EXAMPLE 5 | COMPARATIVE EXAMPLE 15 |
| 21 | 6 | 156 | EMBODIMENT 66 | EMBODIMENT 76 | COMPARATIVE EXAMPLE 6 | COMPARATIVE EXAMPLE 16 |
| 22 | 7 | 182 | EMBODIMENT 67 | EMBODIMENT 77 | COMPARATIVE EXAMPLE 7 | COMPARATIVE EXAMPLE 17 |
| 23 | 8 | 208 | EMBODIMENT 68 | EMBODIMENT 78 | COMPARATIVE EXAMPLE 8 | COMPARATIVE EXAMPLE 18 |
| 24 | 9 | 234 | EMBODIMENT 69 | EMBODIMENT 79 | COMPARATIVE EXAMPLE 9 | COMPARATIVE EXAMPLE 19 |
| 25 | 10 | 260 | EMBODIMENT 70 | EMBODIMENT 80 | COMPARATIVE EXAMPLE 10 | COMPARATIVE EXAMPLE 20 |

FIG. 23

| NO | LED UNIT POWER [W] | TOTAL POWER [W] | CHANNEL STRUCTURE | | PLATE/PIN COMBINATION STRUCTURE | |
|---|---|---|---|---|---|---|
| | | | MULTIPLE ARRAY | SINGLE ARRAY | MULTIPLE ARRAY | SINGLE ARRAY |
| 16 | 2 | 52 | 30 | 31.8 | 33.9 | 37.3 |
| 17 | 3 | 78 | 40.4 | 42.9 | 46.3 | 51.8 |
| 18 | 4 | 104 | 50.4 | 53.7 | 58.3 | 65.9 |
| 19 | 4.65 | 120.9 | 54.3 | 57.2 | 62.5 | 75 |
| 20 | 5 | 130 | 60.3 | 64.4 | 70.1 | 79.9 |
| 21 | 6 | 156 | 69.9 | 74.7 | 81.4 | 93.5 |
| 22 | 7 | 182 | 79.2 | 84.7 | 92.4 | 106.7 |
| 23 | 8 | 208 | 88.1 | 94.2 | 103 | 119.6 |
| 24 | 9 | 234 | 96.6 | 103.5 | 113.2 | 132.1 |
| 25 | 10 | 260 | 104.9 | 112.4 | 123 | 144.3 |

FIG. 25

| NO | HEAT DISSIPATION STRUCTURE | ARRAY TYPE | 120 W | 120 W | 150 W | 150 W |
|---|---|---|---|---|---|---|
| | | | 205 W/mK | 100 W/mK | 205 W/mK | 100 W/mK |
| 26 | CHANNEL | MULTIPLE | EMBODIMENT 81 | EMBODIMENT 83 | EMBODIMENT 85 | EMBODIMENT 87 |
| 27 | PLATE/PIN COMBINATION | MULTIPLE | COMPARATIVE EXAMPLE 21 | COMPARATIVE EXAMPLE 27 | COMPARATIVE EXAMPLE 33 | COMPARATIVE EXAMPLE 39 |
| 28 | PIN/PIN COMBINATION | MULTIPLE | COMPARATIVE EXAMPLE 22 | COMPARATIVE EXAMPLE 28 | COMPARATIVE EXAMPLE 34 | COMPARATIVE EXAMPLE 40 |
| 29 | PIN SHAPE | MULTIPLE | COMPARATIVE EXAMPLE 23 | COMPARATIVE EXAMPLE 29 | COMPARATIVE EXAMPLE 35 | COMPARATIVE EXAMPLE 41 |
| 30 | CHANNEL | SINGLE | EMBODIMENT 82 | EMBODIMENT 84 | EMBODIMENT 86 | EMBODIMENT 88 |
| 31 | PLATE/PIN COMBINATION | SINGLE | COMPARATIVE EXAMPLE 24 | COMPARATIVE EXAMPLE 30 | COMPARATIVE EXAMPLE 36 | COMPARATIVE EXAMPLE 42 |
| 32 | PIN/PIN COMBINATION | SINGLE | COMPARATIVE EXAMPLE 25 | COMPARATIVE EXAMPLE 31 | COMPARATIVE EXAMPLE 37 | COMPARATIVE EXAMPLE 43 |
| 33 | PIN SHAPE | SINGLE | COMPARATIVE EXAMPLE 26 | COMPARATIVE EXAMPLE 32 | COMPARATIVE EXAMPLE 38 | COMPARATIVE EXAMPLE 44 |
| 34 | CHANNEL | COLUMN | EMBODIMENT 89 | EMBODIMENT 90 | EMBODIMENT 91 | EMBODIMENT 92 |

FIG. 26

| NO | HEAT DISSIPATION STRUCTURE | ARRAY TYPE | 120 W | 120 W | 150 W | 150 W |
|---|---|---|---|---|---|---|
| | | | 205 W/mK | 100 W/mK | 205 W/mK | 100 W/mK |
| 26 | CHANNEL | MULTIPLE | 54.3 | 59.4 | 59 | 68 |
| 27 | PLATE/PIN COMBINATION | MULTIPLE | 62.5 | 74.2 | 71.9 | 83.7 |
| 28 | PIN/PIN COMBINATION | MULTIPLE | 68.4 | 80.6 | 74.2 | 86 |
| 29 | PIN SHAPE | MULTIPLE | 75 | 88.77 | 80.6 | 94 |
| 30 | CHANNEL | SINGLE | 57.2 | 65.6 | 65.5 | 75.5 |
| 31 | PLATE/PIN COMBINATION | SINGLE | 75 | 99 | 81.2 | 105.1 |
| 32 | PIN/PIN COMBINATION | SINGLE | 78 | 102.5 | 83.6 | 107.8 |
| 33 | PIN SHAPE | SINGLE | 94.8 | 132.2 | 100.1 | 136.8 |
| 34 | CHANNEL | COLUMN | 56.9 | 63.8 | 52 | 58.7 |

(a) (b)

LIGHT-EMITTING DIODE LIGHT FIXTURE WITH CHANNEL-TYPE HEAT DISSIPATION SYSTEM

RELATED APPLICATION

This application claims the benefit of Korean Patent Application No. 10-2014-0037249, filed on Mar. 28, 2014, in the Korean Intellectual Property Office, the disclosure of which is incorporated herein in its entirety by reference.

BACKGROUND

1. Field

One or more embodiments of the present disclosure relate to a light-emitting diode (LED) light fixture, and more particularly, to an LED light fixture with a channel-type heat dissipation system including a plurality of light-emitting devices including LEDs, a heat dissipation unit connected with the light-emitting devices and having the light-emitting devices mounted thereon, a casing accommodating the heat dissipation unit and the light-emitting devices, a cover connected with the casing, disposed above the light-emitting devices, and that is light-transmissive, and a ventilation channel through which ambient air passes, in which the casing has one open surface, the cover is connected to cover the open surface, the heat dissipation unit has an upper surface exposed through the open surface and a lower surface, the light-emitting devices are connected to the upper surface of the heat dissipation unit and exposed through the open surface, the heat dissipation unit includes a plurality of ridge portions extending in at least one direction and furrow portions formed between the ridge portions, the casing includes a plurality of vent holes, and the ventilation channel includes air flow paths formed by the furrow portions and the vent holes formed in the casing.

2. Description of the Related Art

An LED is a light-emitting device that generates light when electrons and holes combine in an active layer. Although an LED is environmentally friendly and consumes low power, the LED generates light of high brightness and thus is attracting attention as a next-generation light-emitting device. Accordingly, light-emitting devices employing LEDs are widely being developed and used and also use of LEDs is being recommended and supported in many ways nationally.

As flat panel display devices, flexible devices, LEDs, packages for vehicles, small electronic devices, and information and communication devices become slim and integrated, a countermeasure against heat is at issue. In particular, light fixtures employing LEDs have high illumination intensity in spite of low energy consumption and may be used for a long time due to a long lifespan. Also, light fixtures employing LEDs do not require mercury for light emission. In other words, light fixtures employing LEDs are environmentally friendly, and thus, are under development in many ways to replace incandescent lamps, fluorescent lamps, and metal halide lamps that have high energy consumptions and short lifespans. Such an LED device is a photoelectric device, has a junction of p-type and n-type semiconductors, and is a light source that emits energy corresponding to the band gap of the semiconductor in the form of light due to the combination of electrons and holes when a voltage is applied. Recently, LEDs of various colors, including blue, have been developed and are being applied to various usages, such as large outdoor electronic displays, traffic lights, car instrument panels, and street lights, because it is possible to display natural colors.

An LED as a white light source emits only about 15% to about 25% of its total heat energy as radiant energy and emits all the other heat energy behind its heat source by conduction and convection, unlike a fluorescent lamp, an incandescent lamp, or a metal halide lamp that has a high efficiency in converting electric power into light, but directly emits about 58% to about 81% of its total heat energy as radiant energy. Since the emitted heat has direct effects on semiconductor devices around a light-emitting unit, the LED as a white light source is very vulnerable to heat, compared to a light-emitting device, such as an incandescent lamp employing a filament or a fluorescent lamp employing cathode rays. Therefore, in order to apply a large amount of current to an LED, a heat dissipation structure for efficiently emitting heat generated from the LED to the ambient air by conduction and convection becomes a very important element.

Problems caused by overheating of an LED light source include the degradation of optical power resulting from a change in the refractive index of an LED encapsulant, thermal deformation at a bimaterial interface, a reduction in the lifespan of an LED resulting from discoloration, the performance degradation of a fluorescent body resulting from die break and stripping, and so on. In order to prevent such degradation of an LED light source, a variety of heat dissipation countermeasures are being attempted. As a typical heat dissipation countermeasure, thermal interface materials (TIMs) capable of reducing a contact thermal resistance and heat sinks having heat dissipation fins of various forms are in use. TIMs are intended to reduce contact thermal resistance between an LED package and a printed circuit board (PCB) substrate, or between a PCB and a heat sink, and used as thermally conductive materials in the form of paste, grease, and tape. However, first of all, it is necessary to design the optimal structure of a heat dissipation system, such as a heat sink, that is most important for the improvement of heat dissipation characteristics.

Heat sinks are mainly used in the form of heat dissipation fins or pins, that is, in a plate shape or a pin shape. Although there are a variety of forms of heat sinks, the heat sinks are inserted in outer cases designed to protect an external design, electronic parts, a circuit package, modules, and so on. For example, in the case of an LED light fixture having high output power in which LED light sources are arranged in a columnar array structure or in a multiple array structure, such as a street light, high heat is generated, and thus a heat sink in which as many pin-shaped or plate-shaped heat dissipation fins as possible are arranged to have a large area is used. However, due to a limitation on the internal space of a light fixture and regulations on the weight, it is necessary to design a heat sink to be as compact as possible according to the space of the fixture and also as light as possible. For this reason, it is difficult to improve heat dissipation characteristics.

SUMMARY

One or more embodiments of the present disclosure include a light-emitting diode (LED) light fixture with a channel-type heat dissipation system, the LED light fixture including a plurality of light-emitting devices including LEDs, a heat dissipation unit connected with the plurality of light-emitting devices and having the plurality of light-emitting devices mounted thereon, a casing accommodating the heat dissipation unit and the light emitting devices, a cover connected with the casing, disposed above the plurality of light-emitting devices, and that is light-transmissive, and a ventilation channel through which ambient air passes. The casing has one open surface. The cover is connected to cover the open surface. The heat dissipation unit has an upper surface exposed through the open surface and a lower surface. The plurality of light-emitting devices are connected to the lower surface of the heat dissipation unit and exposed through the open surface. The heat dissipation unit includes a plurality of ridge portions extending in at least one direction and a plurality of furrow portions formed between the ridge portions. The casing includes a plurality of vent holes. The ventilation channel includes air flow paths formed by the furrow and ridge portions in the inner and outer side of the heat dissipation unit. The casing may include a plurality of vent holes formed in the cover when the cover is needed for use.

Additional aspects will be set forth in part in the description which follows and, in part, will be apparent from the description, or may be learned by practice of the presented embodiments.

According to one or more embodiments of the present disclosure, an LED light fixture with a channel-type heat dissipation system includes a plurality of light-emitting devices including LEDs, a heat dissipation unit connected with the plurality of light-emitting devices and having the plurality of light-emitting devices mounted thereon, a casing accommodating the heat dissipation unit and the light emitting devices, a cover connected with the casing, disposed above the plurality of light-emitting devices, and that is light-transmissive, and a ventilation channel through which ambient air passes. The casing has one open surface. The cover is connected to cover the open surface. The heat dissipation unit has an upper surface exposed through the open surface and a lower surface. The plurality of light-emitting devices are connected to the lower surface of the heat dissipation unit and exposed through the open surface. The heat dissipation unit includes a plurality of ridge portions extending in at least one direction and a plurality of furrow portions formed between the ridge portions. The casing includes a plurality of vent holes. The ventilation channel includes air flow paths formed by the furrow and ridge portions and the plurality of vent holes formed in the casing for optimal heat dissipation.

Preferably, the ridge portions may have at least first and second ridge portions, the furrow portions may have at least first and second furrow portions, the first and second ridge portions may extend to cross at a predetermined angle, and the first and second furrow portions may also extend to cross at a predetermined angle.

Preferably, the ridge portions and the furrow portions may be symmetrically arranged in at least one direction selected from a group consisting of length directions, up-and-down directions, and forward-and-backward directions for aerodynamic design optimization of the heat dissipation system.

Preferably, a plurality of bent portions may be formed in the upper surface and the lower surface of the heat dissipation unit to have concave and convex patterns, the plurality of ridge portions and the plurality of furrow portions may be alternately formed by the plurality of bent portions, and the plurality of ridge portions and the plurality of furrow portions may be formed at symmetrical positions in at least a portion on the upper surface and the lower surface of the heat dissipation unit.

Preferably, the heat dissipation unit may be configured so that a member in a form of a predetermined plate is bent several times to form a plurality of bent portions, the plurality of ridge portions and the plurality of furrow portions may be alternately formed by the plurality of bent portions, and the plurality of ridge portions and the plurality of furrow portions may be formed at symmetrical positions in at least a portion on the upper surface and the lower surface of the heat dissipation unit.

Preferably, the heat dissipation unit may include a plurality of predetermined protruding solid structures, the plurality of predetermined protruding solid structures may constitute the plurality of ridge portions, and spaces between the plurality of predetermined protruding solid structures may constitute the plurality of furrow portions.

Preferably, at least some of the plurality of vent holes may be formed at both ends of the at least one direction in which the ridge portions and the furrow portions extend on both side surfaces of the casing.

Preferably, at least some of the plurality of vent holes may overlap at least a part of at least one selected from a group consisting of the plurality of ridge portions and the plurality of furrow portions in a penetration direction of the plurality of vent holes and in a direction in which the plurality of ridge portions or the plurality of furrow portions extend, so that air flowing through the plurality of vent holes moves along the ridge portions or the furrow portions.

Preferably, the plurality of light-emitting devices may be mounted on the plurality of ridge portions on the upper surface of the heat dissipation unit.

Preferably, the plurality of light-emitting devices may be mounted on the plurality of ridge portions on the upper surface of the heat dissipation unit, and a plurality of light-emitting devices may be mounted along an extending direction of each ridge portion to constitute a plurality of arrays.

Preferably, the LED light fixture may further include a substrate unit on which the plurality of light-emitting devices are mounted. The substrate unit may be attached to the upper surface of the heat dissipation unit.

Preferably, the plurality of light-emitting devices may be disposed in one or more arrays on the substrate unit.

Preferably, the substrate unit may be configured in a form of a bar extending long with a predetermined width and a predetermined length, and the substrate unit may be plural in number and attached onto the plurality of ridge portions and spaced apart from each other with the furrow portions interposed there between.

Preferably, the casing may have at least one open surface and may be configured in a form of a three-dimensional (3D) solid in which an accommodation space is formed, and the heat dissipation unit may be embedded in the accommodation space.

Preferably, the casing may be configured in a form of a hexahedron to have a rectangular horizontal cross-section and a rectangular longitudinal cross-section.

Preferably, the casing may have an upper surface configured in a form of an ellipse, and the upper surface may be curved to have a dome shape.

Preferably, a porous heat dissipation composite may be applied to at least a portion of the lower surface of the heat dissipation unit.

Preferably, the light-emitting devices may include a predetermined lens unit through which light generated by the LEDs is refracted.

Preferably, at least a portion of the cover may be inserted in and connected to at least a portion of the casing.

Preferably, the cover may have a predetermined connecting unit and is connected with the casing through the connecting unit, and a tight gasket may be prepared on a surface in contact with the casing.

BRIEF DESCRIPTION OF THE DRAWINGS

These and/or other aspects will become apparent and more readily appreciated from the following description of the embodiments, taken in conjunction with the accompanying drawings in which:

FIGS. 16 to 29 are diagrams for comparison between embodiments of the present disclosure and the comparative examples.

DETAILED DESCRIPTION

Figure 1:
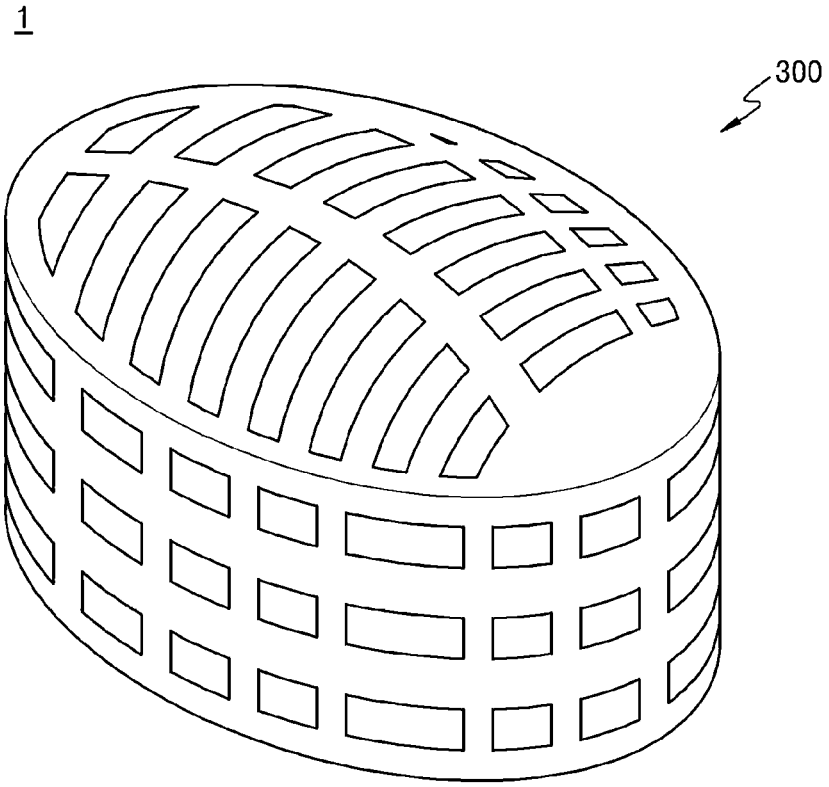
FIG. 1 is a diagram of a light-emitting diode (LED) light fixture with a channel-type heat dissipation system, according to an embodiment of the present disclosure.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. Expressions such as "at least one of," when preceding a list of elements, modify the entire list of elements and do not modify the individual elements of the list.

Spatially relative terms, such as "below", "above", and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "below" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the disclosure. As used herein, the singular forms "a", "an", and "the" are intended to include the plural forms as well, unless the context clearly indicates otherwise. It will be further understood that the terms "includes" and/or "including," when used in this specification, specify the presence of stated elements, but do not preclude the presence or addition of one or more other elements.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In the drawings, lengths and sizes of individual parts may be exaggerated or omitted, or schematically illustrated for convenience and clarity of description. Lengths and sizes of individual components do not fully reflect the actual sizes or areas.

Terms indicating directions of usage and orientations herein are not limited to specific positions and directions. In other words, "above" and "below" or "upward" and "downward" are used with reference to drawings, and may be understood to indicate different directions and positions according to the orientation of a light-emitting diode (LED) light fixture 1 with a channel-type heat dissipation system, according to an embodiment of the present disclosure, and the orientation of each member.

Figure 2:
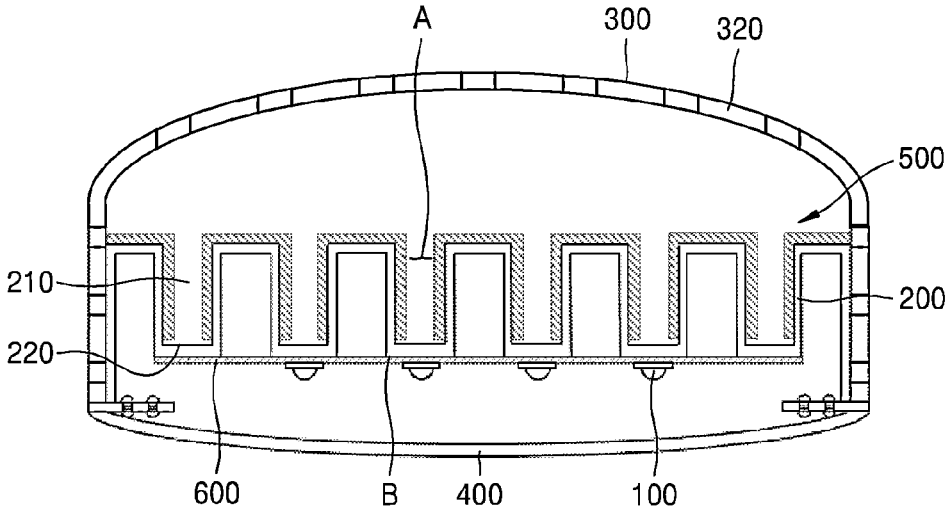
FIG. 2 is a diagram showing the internal structure of the LED light fixture with a channel-type heat dissipation system, according to an embodiment of the present disclosure.
Figure 3:
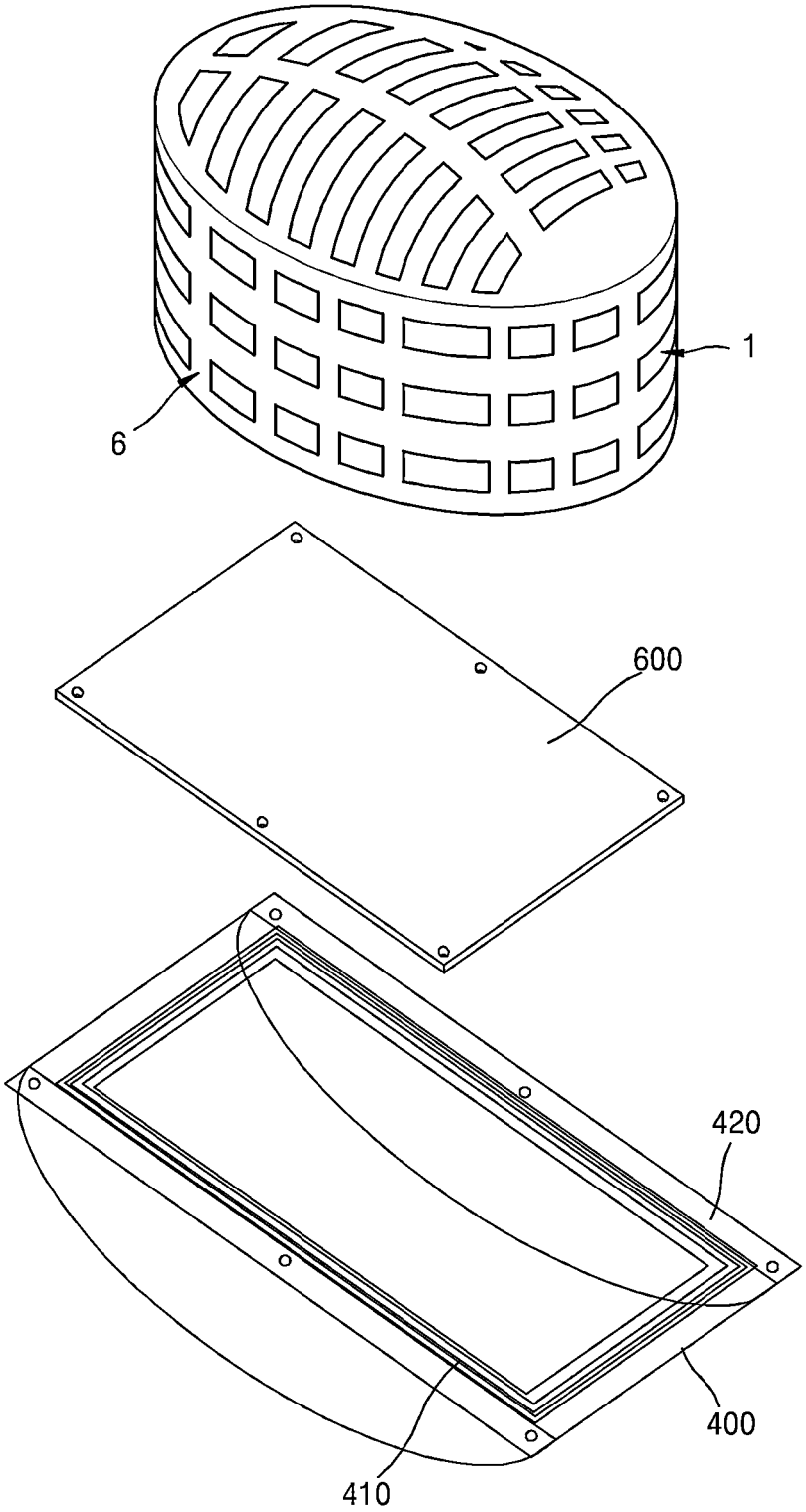
FIG. 3 is an exploded view of the LED light fixture with a channel-type heat dissipation system, according to an embodiment of the present disclosure.
Figure 4:
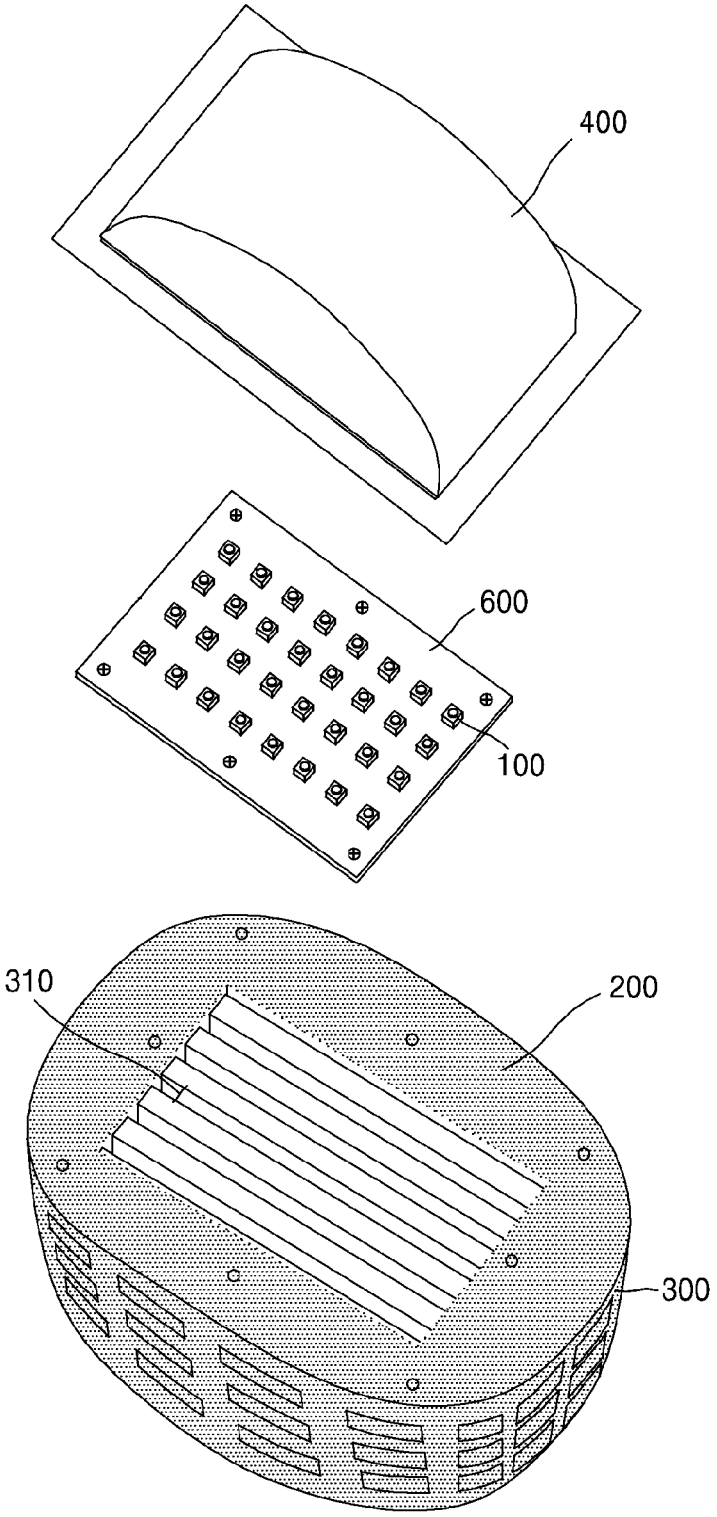
FIG. 4 is an exploded view of the LED light fixture with a channel-type heat dissipation system, according to an embodiment of the present disclosure.
Figure 5:
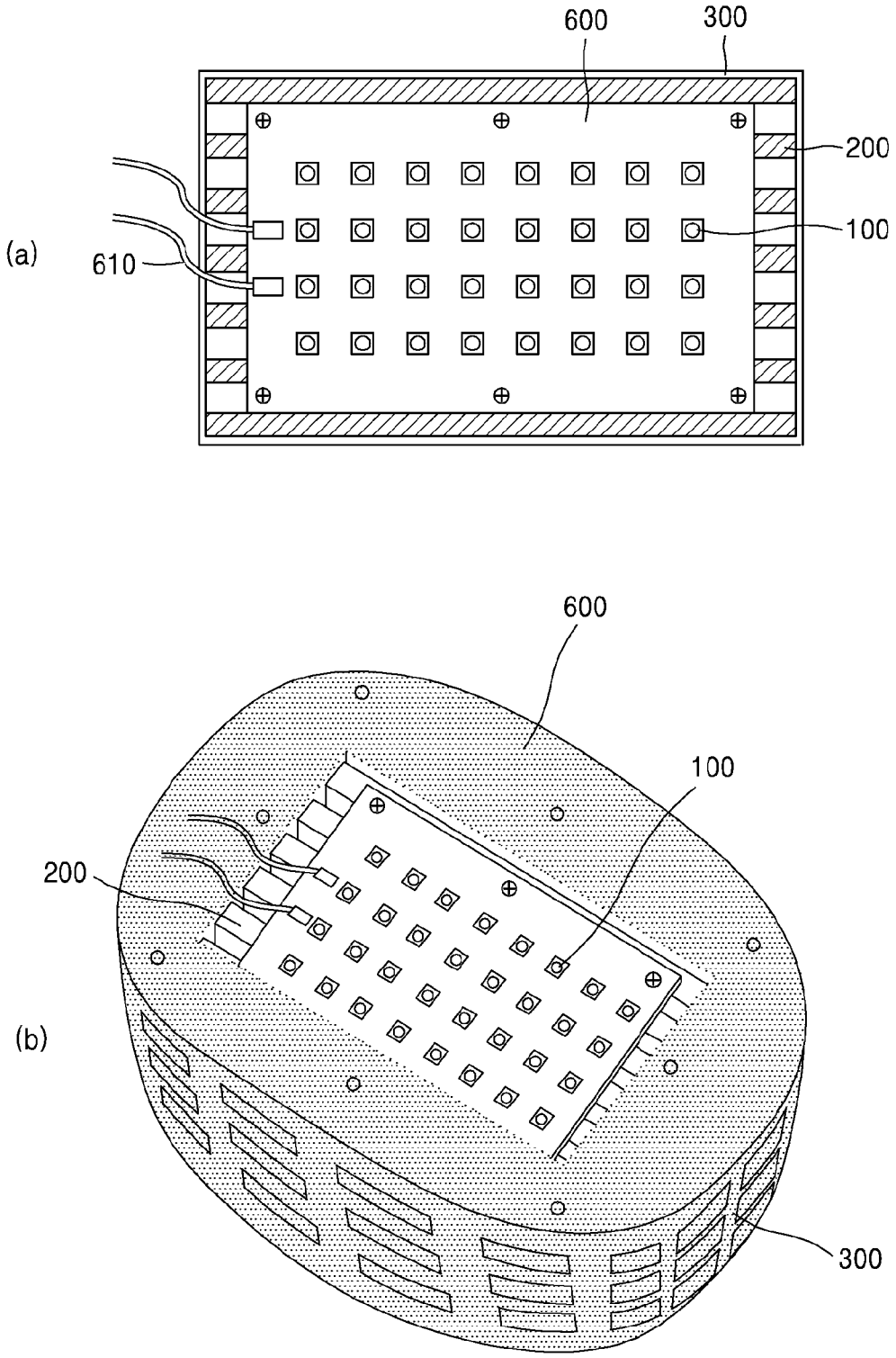
FIG. 5 is a diagram showing the structure of the LED light fixture with a channel-type heat dissipation system, according to an embodiment of the present disclosure.
Figure 6:
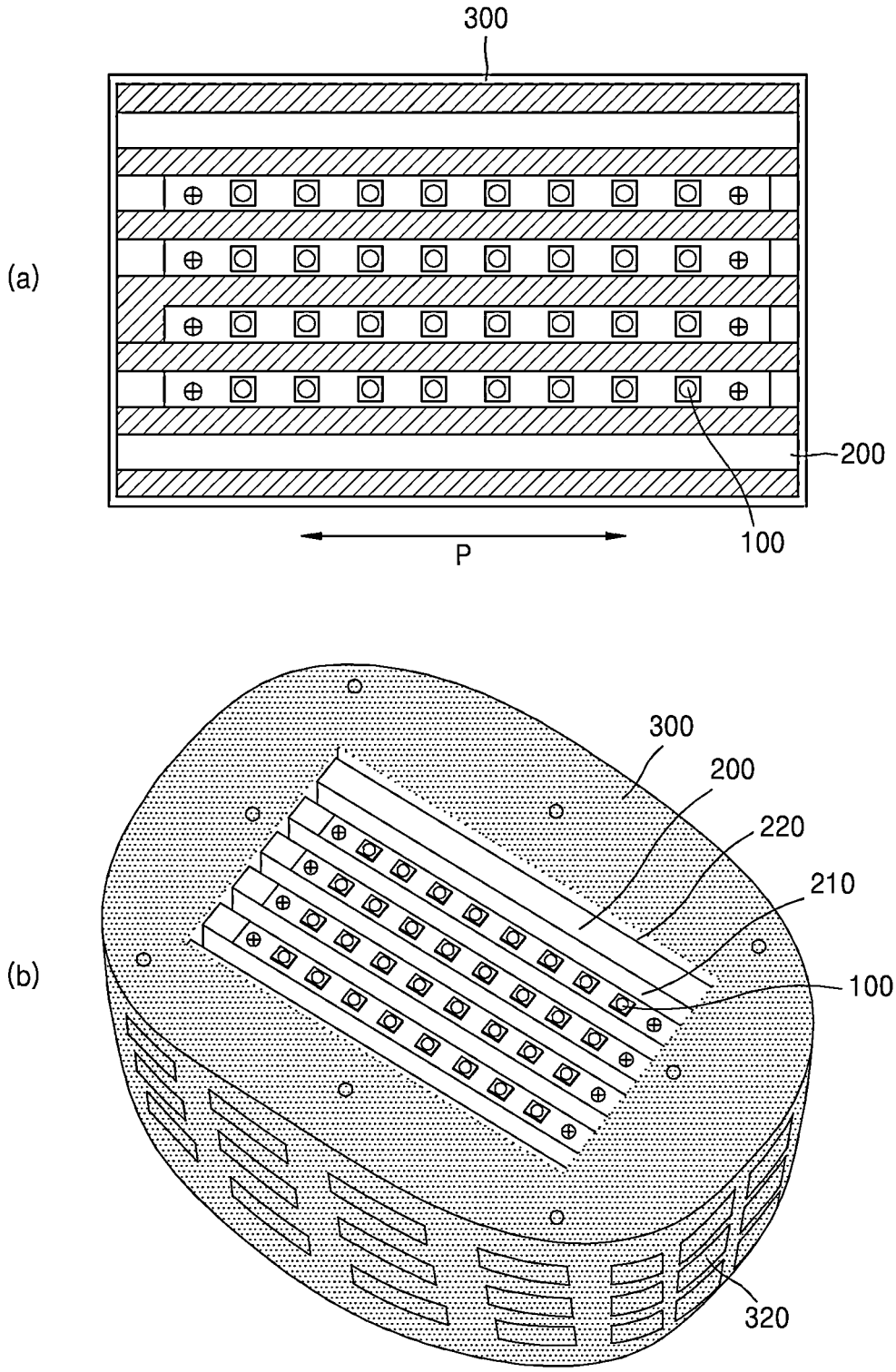
FIG. 6 is a diagram showing the structure of a heat dissipation system according to an embodiment of the present disclosure.
Figure 7:
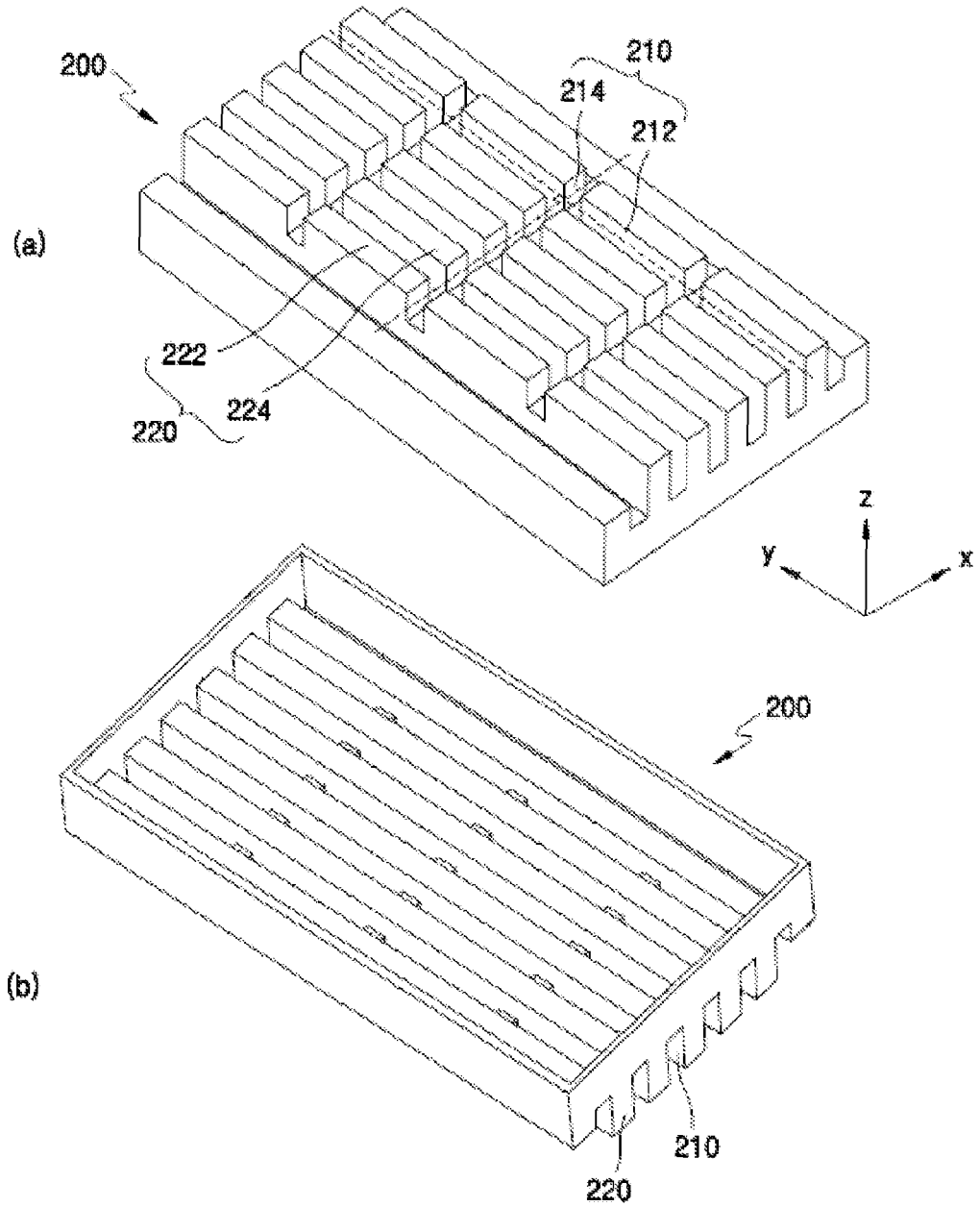
FIG. 7 is a diagram showing the structure of a heat dissipation unit according to an embodiment of the present disclosure.
Figure 8:
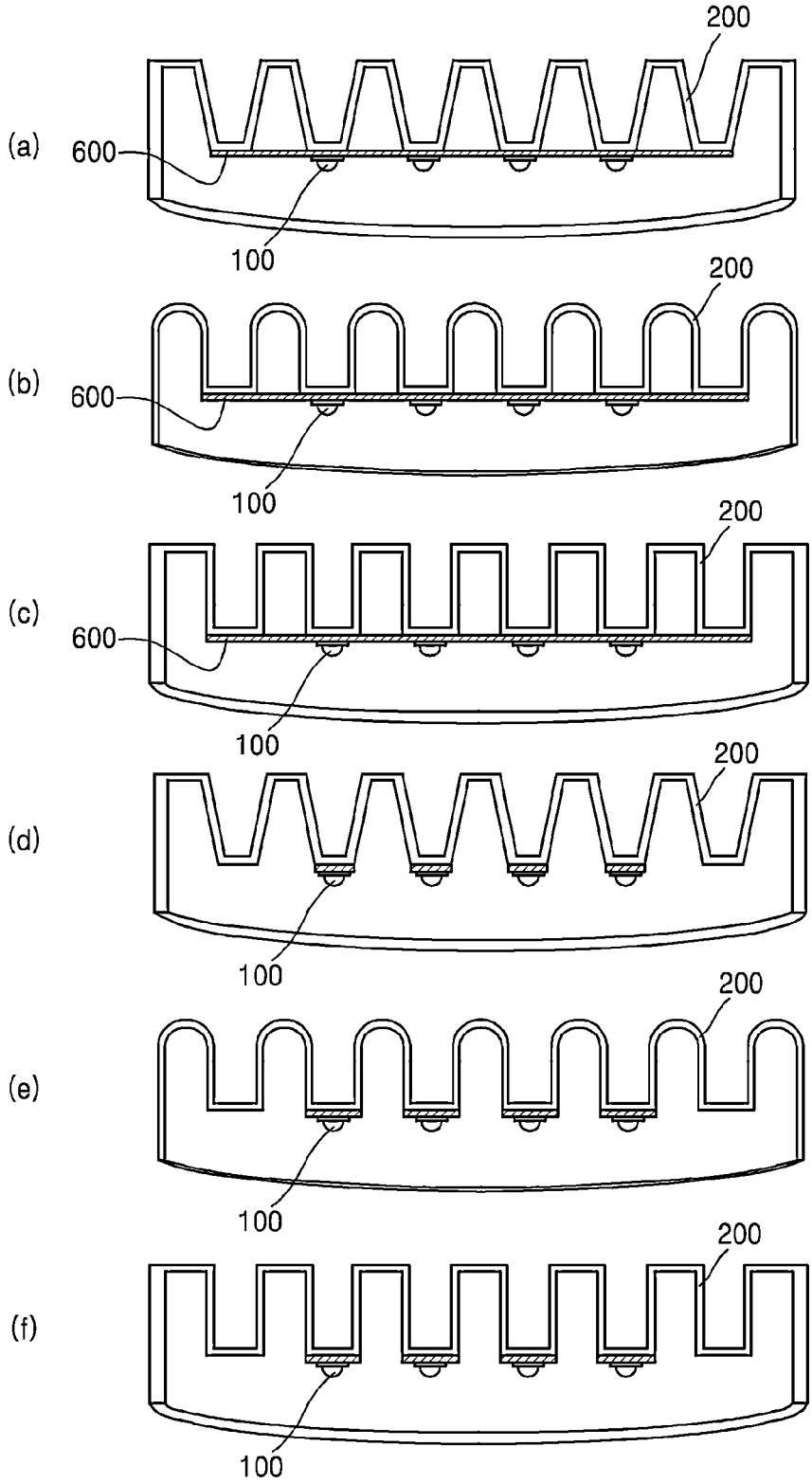
FIG. 8 is a diagram showing the internal structure of the LED light fixture with a channel-type heat dissipation system, according to an embodiment of the present disclosure.
Figure 9:
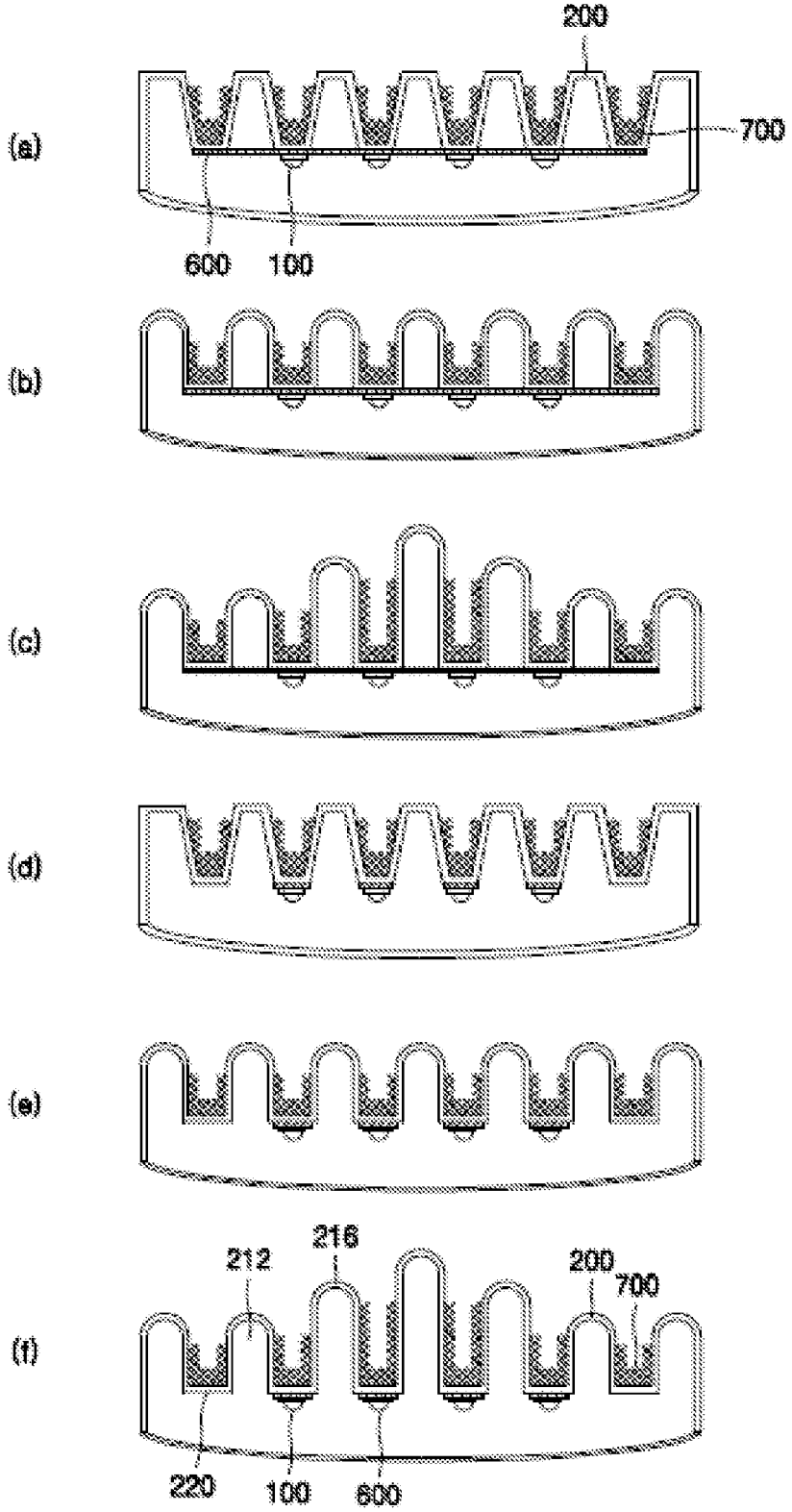
FIG. 9 is a diagram showing the internal structure of the LED light fixture with a channel-type heat dissipation system, according to an embodiment of the present disclosure.

FIG. 1 is a diagram of the LED light fixture 1 with a channel-type heat dissipation system, according to an embodiment of the present disclosure, FIG. 2 is a diagram showing the internal structure of the LED light fixture 1 with a channel-type heat dissipation system, according to an embodiment of the present disclosure, FIG. 3 is an exploded view of the LED light fixture 1 with a channel-type heat dissipation system, according to an embodiment of the present disclosure, FIG. 4 is an exploded view of the LED light fixture 1 with a channel-type heat dissipation system, according to an embodiment of the present disclosure, FIG. 5 is a diagram showing the structure of the LED light fixture 1 with a channel-type heat dissipation system, according to an embodiment of the present disclosure, FIG. 6 is a diagram showing the structure of a heat dissipation system according to an embodiment of the present disclosure, FIG. 7 is a diagram showing the structure of a heat dissipation unit 200 according to an embodiment of the present disclosure, FIG. 8 is a diagram showing the internal structure of the LED light fixture 1 with a channel-type heat dissipation system, according to an embodiment of the present disclosure, and FIG. 9 is a diagram showing the internal structure of the LED light fixture 1 with a channel-type heat dissipation system, according to an embodiment of the present disclosure.

The LED light fixture 1 with a channel-type heat dissipation system, according to an embodiment of the present disclosure, includes a plurality of light-emitting devices 100 including LEDs, a heat dissipation unit 200 connected with the light-emitting devices 100 and having the light-emitting devices 100 mounted thereon, a casing 300 accommodating the heat dissipation unit 200 and the light-emitting devices 100, a cover 400 connected with the casing 300, disposed above the light-emitting devices 100, and that is light-transmissive, and a ventilation channel 500 through which ambient air passes.

The casing 300 has one open surface 310, and the cover 400 is connected with the casing 300 to cover the open surface 310. The heat dissipation unit 200 has an upper surface and a lower surface, and the upper surface is exposed through the open surface 310 of the casing 300. The light-emitting devices 100 are connected to the upper surface of the heat dissipation unit 200 and exposed through the open surface 310. The heat dissipation unit 200 includes a plurality of ridge portions 220 extending in at least one direction and furrow portions 210 formed between the ridge portions 220. The casing 300 includes a plurality of vent holes 320. The ventilation channel 500 includes air flow paths formed by the ridge portions 220 and the furrow portions 210, and the vent holes 320 formed in the casing 300.

The light-emitting devices 100 substantially generate light when external power is applied and may include LEDs. For example, each of the light-emitting devices 100 may be a light-emitting device package in which an LED is mounted, and the plurality of light-emitting devices 100 may be configured to form at least one array, constituting a light-emitting device array.

The light-emitting devices 100 may include a predetermined lens unit through which light generated by the LEDs is refracted. The lens unit may concentrate or diffuse the light generated by the LEDs, but is not limited to these functions.

The heat dissipation unit 200 constitutes a region where the light-emitting devices 100 are mounted and may be formed of a material that is appropriate for dissipation of heat generated by the light-emitting devices 100. As an example, the heat dissipation unit 200 may be formed of a metal with excellent thermal conductivity, such as aluminum, copper, or stainless steel, but is not limited to these materials. The heat dissipation unit 200 is a member having a predetermined area and thickness, and may have a predetermined solid body, such as the ridge portions 220 and the furrow portions 210, as described later. The light-emitting devices 100 may not only be mounted on and in contact with the heat dissipation unit 200, but also may be mounted on the heat dissipation unit 200 through a medium of a predetermined substrate as described later. However, the mounting of the light-emitting devices 100 is not limited to these forms.

The heat dissipation unit 200 includes the plurality of ridge portions 220 that extend in parallel with each other and the furrow portions 210 formed between the ridge portions 220. In other words, as shown in the drawings, the heat dissipation unit 200 may have a structure of repeated concave and convex patterns, each of which may constitute a ridge and a furrow extending in at least one direction. Accordingly, the ridge portions 220 and the furrow portions 210 are alternately formed.

The casing 300 has an accommodation space for accommodating the heat dissipation unit 200 and the light-emitting devices 100, protects the light-emitting devices 100 from the surroundings, such as direct sunlight, external impact, etc., and gives the appearance of the LED light fixture 1 with a channel-type heat dissipation system according to an embodiment of the present disclosure. The casing 300 may be configured in the form of a predetermined solid body, and may have the predetermined vent holes 320 through which air may pass.

The casing 300 has the one open surface 310. Through the open surface 310, the light-emitting devices 100 accommodated in the casing 300 may be exposed and light generated by the light-emitting devices 100 may be emitted. In other words, the light-emitting devices 100 and the heat dissipation unit 200 may be accommodated and disposed in the casing 300 so that the light generated by the light-emitting devices 100 may be emitted through the open surface 310.

When a surface of the heat dissipation unit 200, on which the light-emitting devices 100 are mounted, is referred to as an upper surface, it is possible to say that the upper surface is exposed through the open surface 310 of the casing 300. In other words, the light-emitting devices 100 are mounted on the upper surface of the heat dissipation unit 200, and the upper surface is exposed through the open surface 310 of the casing 300, so that the light-emitting devices 100 mounted on the upper surface are exposed through the open surface 310 and the light generated by the light-emitting devices 100 is emitted through the open surface 310. In FIG. 2, the upper surface is denoted by B, and the lower surface is denoted by A. Although A is shown above B in the drawing, the surface exposed through the open surface 310 has been described as the upper surface indicated by B.

As an example, the casing 300 may be configured in the form of a hexahedron, a cylinder, or a curved three-dimensional (3D) figure having a predetermined internal space. At least one of the surfaces constituting the polyhedron may be opened to be the open surface 310, and the internal space may be configured to serve as the accommodation space for accommodating the light-emitting devices 100 and the heat dissipation unit 200. In other words, the shape of the casing 300 may vary and is not limited to the drawings. For example, in the drawing, the casing 300 is configured in the form of a cylindroid overall and has a dome shape that has an upper surface that is curved and convex, but is not limited to the dome shape. Here, the upper surface has a different concept from the upper surface of the heat dissipation unit 200 and has an opposite concept to a surface of the casing 300 in which the open surface 310 is formed. As another example, the casing 300 may be configured in the form of a cuboid that has a rectangular horizontal cross-section and a rectangular longitudinal cross-section.

The predetermined cover 400 is connected to the open surface 310. The cover 400 is formed of a light-transmissive material. Light generated by the light-emitting devices 100 may pass through the cover 400, and the cover 400 may protect the light-emitting devices 100 exposed through the open surface 310.

The cover 400 is connected to the casing 300, and a predetermined connection unit 420 may be prepared for connection on a circumferential portion of the cover 400. A predetermined tight gasket 410 may be prepared to prevent penetration of foreign materials, moisture, etc. between the cover 400 and the casing 300. At least a portion of the cover 400 may have a connection structure to be inserted in and connected to at least a portion of the casing 300, but the connection structure is not limited to this form.

The LED light fixture 1 with a channel-type heat dissipation system, according to an embodiment of the present disclosure, includes the predetermined ventilation channel 500. The ventilation channel 500 is prepared in the casing 300. The ambient air passes through the ventilation channel 500 to exchange internal heat with external heat, so that the temperature of the LED light fixture 1 with a channel-type heat dissipation system is lowered. The ventilation channel 500 may include spaces formed by the above-described individual members in addition to separate members, portions formed by connecting the individual members, or so on.

The ventilation channel 500 may include the air flow paths formed by the furrow portions 210 and the vent holes 320 formed in the casing 300. In other words, as described above, the plurality of ridge portions 220 and the plurality of furrow portions 210 are formed in the heat dissipation unit 200. Air flows through the ridge portions 220 and the furrow portions 210, so that the ridge portions 220 and the furrow portions 210 may serve as predetermined air flow paths. Also, the vent holes 320 are formed in the casing 300 so that ambient air may flow in the casing 300 through the vent holes 320.

Air flowing in the casing 300 through the vent holes 320 moves through the ridge portions 220 and the furrow portions 210 serving as the air flow paths and may flow back out through the vent holes 320 formed in the casing 300. During this process, heat in the LED light fixture 1 with a channel-type heat dissipation system may be emitted to the outside, so that the LED light fixture 1 with a channel-type heat dissipation system, according to an embodiment of the present disclosure, may be cooled. Accordingly, the ridge portions 220 and the furrow portions 210 formed in the heat dissipation unit 200 and the vent holes 320 formed in the casing 300 constitute the above-described ventilation channel 500.

As described above, the LED light fixture 1 with a channel-type heat dissipation system, according to an embodiment of the present disclosure, includes the heat dissipation unit 200 having the ridge portions 220 and the furrow portions 210, and the casing 300 having the vent holes 320. Since the ridge portions 220 and the furrow portions 210 formed in the heat dissipation unit 200 and the vent holes 320 formed in the casing 300 constitute the ventilation channel 500, air flow is promoted and heat generated by the light-emitting devices 100 is readily dissipated. Therefore, the LED light fixture 1 with a channel-type heat dissipation system may be improved in heat dissipation efficiency.

In addition, since the ventilation channel 500 is configured with the ridge portions 220 and the furrow portions 210 of the heat dissipation unit 200, the heat dissipation area of the heat dissipation unit 200 increases. Accordingly, a contact area between ambient air and the heat dissipation unit 200 increases, that is, heat exchange efficiency increases, and the heat dissipation efficiency of the LED light fixture 1 with a channel-type heat dissipation system may be further improved.

Various embodiments of the heat dissipation unit 200 will be described in detail below.

In an example, preferably, the heat dissipation unit 200 is configured in the form of a plate having concave and convex patterns due to a plurality of bent portions formed on the upper surface and the lower surface of the heat dissipation unit 200. In the bent portions, the plurality of ridge portions 220 and the plurality of furrow portions 210 are alternately formed, and the plurality of ridge portions 220 and the plurality of furrow portions 210 are formed at symmetrical positions on and under the heat dissipation unit 200, on the left and right sides of the heat dissipation unit 200, or in all directions of the heat dissipation unit 200.

In other words, the heat dissipation unit 200 may be a predetermined plate and may have a bent configuration due to the plurality of bent portions formed in the plate. As mentioned above, the bent portions may be formed to have a configuration in which the plurality of ridge portions 220 and the plurality of furrow portions 210 are alternately formed. Since the heat dissipation unit 200 is configured in the form of a plate as mentioned above, the ridge portions 220 and the furrow portions 210 may be formed symmetrical to each other about both surfaces of the heat dissipation unit 200. In other words, when the both surfaces of the heat dissipation unit 200 are the upper surface and the lower surface, ridge portions 220 formed on the upper surface constitute furrow portions 210 formed on the lower surface. Accordingly, the ridge portions 220 and the furrow portions 210 are alternately formed at positions symmetrical to each other in up-and-down directions, left-and-right directions, forward-and-backward directions, or all directions. In other words, the ridge portions 220 on the upper surface constitute furrow portions 210 on the lower surface, and the furrow portions 210 on the lower surface constitute the ridge portions 220 on the upper surface. Here, the up-and-down directions are a direction from the open surface 310 to the opposite surface and the reverse direction, that is, z-axis directions in FIG. 7, the forward-and-backward directions may be x-axis directions, and the left-and-right directions may be y-axis directions. However, when there is a limitation of the internal space according to the design of the casing 300, the ridge portions 220 and the furrow portions 210 may be formed at positions that are asymmetric to each other.

The heat dissipation unit 200 may not be simply constituted of a plate, but may be constituted of 3D structures having a predetermined volume. In other words, unlike the above-described form in which a member in the form of a plate is simply bent several times to constitute the ridge portions 220 and the furrow portions 210, protruding solid structures having a predetermined thickness may constitute the ridge portions 220, and spaces between the solid structures may constitute the furrow portions 210. The heat dissipation unit 200 is not limited to these constitutions.

In an example, the furrow portions 210 may include at least first and second furrow portions 212 and 214, and the ridge portions 220 may include at least first and second ridge portions 222 and 224. The first furrow portion 212 and the second furrow portion 214 may extend to cross each other at a predetermined angle, and the first ridge portion 222 and the second ridge portion 224 also may extend to cross each other at a predetermined angle.

In other words, unlike in FIG. 7, the ridge portions 220 and the furrow portions 210 do not only extend in parallel with each other, but also may be configured to extend in various directions and cross each other. As an example, the heat dissipation unit 200 may not be constituted of the ridge portions 220 and the furrow portions 210 only, but may have a form in which a plurality of partially protruding portions are prepared and furrow portions 210 extend in several directions between the protruding portions. In this case, the first furrow portion 212 and the second furrow portion 214, and the first ridge portion 222 and the second ridge portion 224 may cross at right angles, but the configuration of the ridge portions and the furrow portions is not limited to such an angle.

The light-emitting devices 100 may be mounted on ridge portions 220 in the upper surface of the heat dissipation unit 200. Here, the upper surface of the heat dissipation unit 200 is not limited to a specific surface, but as described above, denotes a surface exposed through the open surface 310 formed in the casing 300 when the heat dissipation unit 200 is accommodated in the casing 300. The light-emitting devices 100 are mounted on the ridge portions 220 in the upper surface of the heat dissipation unit 200, and thus heat dissipation is further facilitated.

The light-emitting devices 100 are mounted on the ridge portions 220 in the upper surface of the heat dissipation unit 200, and a plurality of light-emitting devices 100 may be mounted along the extending direction of each ridge portion 220 to constitute a plurality of arrays. In other words, when the plurality of ridge portions 220 are formed and the plurality of light-emitting devices 100 are mounted along the ridge portions 220, as many light-emitting device arrays as the number of ridge portions 220 may be formed.

The ridge portions 220 and the furrow portions 210 may have various forms according to the bent portions formed in the heat dissipation unit 200. In other words, as shown in FIGS. 8A to 8F, the ridge portions 220 and the furrow portions 210 may have a predetermined angle or a rounded bottom edge 216 that is a curved configuration, and are not limited to these. In addition, each of the ridge portions 220 and the furrow portions 210 may have at least two different heights and depths and does not necessarily have a uniform height or depth.

Preferably, at least some of the plurality of vent holes 320 formed in the casing 300 are formed at both ends of directions in which the ridge portions 220 and the furrow portions 210 extend on both side surfaces of the casing 300.

In other words, as shown in FIG. 6, the plurality of vent holes 320 are formed in the casing 300, and the at least some of the vent holes 320 may be formed at the both ends of the direction in which the ridge portions 220 and the furrow portions 210 extend. Here, the direction in which the ridge portions 220 and the furrow portions 210 extend denotes a direction in which grooves, recessed portions, protruding portions, etc. constituting the ridge portions 220 and the furrow portions 210 extend, that is, the same direction as an arrow P shown in FIG. 6A. Since the vent holes 320 are formed at the both ends of the direction in which the ridge portions 220 and the furrow portions 210 extend, ambient air flowing in the ridge portions 220 and the furrow portions 210 through vent holes 320 formed on one end may move in the direction in which the ridge portions 220 and the furrow portions 210 extend and may flow out through vent holes 320 formed on the other end. In other words, the ridge portions 220 and the furrow portions 210 serve as air flow paths to promote the flow of air, and cooling and heat dissipation of the LED light fixture 1 with a channel-type heat dissipation system may be achieved more efficiently according to the flow of air. When the ridge portions 220 and the furrow portions 210 extend in two or more directions, the vent holes 320 may be formed to penetrate two or more surfaces.

At least some of the plurality of vent holes 320 may overlap at least a part of at least one selected from the group consisting of the ridge portions 220 and the furrow portions 210 in a penetration direction of the vent holes 320 and in the direction in which the ridge portions 220 and the furrow portions 210 extend, so that air flowing through the vent holes 320 may move along the ridge portions 220 or the furrow portions 210.

In other words, when a predetermined medium flows in the casing 300 through vent holes 320 on one side, the medium may move along the ridge portions 220 or the furrow portions 210 and escape through vent holes 320 on the opposite side. Accordingly, air flowing in the casing 300 through vent holes 320 on one side may readily move along flow paths formed through the ridge portions 220 or the furrow portions 210 and readily escape through vent holes 320 on the opposite side.

In particular, when ambient air flows in the casing 300 in a random direction, if the air flow paths of the ridge portions 220 and the furrow portions 210 are in the P direction and a direction perpendicular to the P direction along a curved surface, cooling and heat dissipation of the LED light fixture 1 with a channel-type heat dissipation system may be achieved more efficiently.

In an embodiment, the LED light fixture 1 with a channel-type heat dissipation system may further include a substrate unit 600 on which the plurality of light-emitting devices 100 are mounted, and the substrate unit 600 may be attached to the heat dissipation unit 200.

The substrate unit 600 is a member having a predetermined area so that the plurality of light-emitting devices 100 are attached to the substrate unit 600. On the substrate unit 600, the light-emitting devices 100 may be mounted in a predetermined array.

As an example, a substrate unit 600 may have an area that covers the plurality of ridge portions 220 and the plurality of furrow portions 210, thus having a multiple array structure in which the light-emitting devices 100 are mounted in a plurality of arrays. As another example, a plurality of substrate units 600, on which the light-emitting devices 100 are mounted in columns, may be attached onto the ridge portions 220 to correspond to the area of the ridge portions 220, thus having a columnar array structure. As another example, a substrate unit 600 having an area corresponding to one ridge portion 220 may be attached to each ridge portion 220, thus having a single array structure in which one light-emitting device array is formed on each substrate unit 600.

In the case of the columnar array structure, each substrate unit 600 is configured in the form of a bar that extends long with a predetermined width and a predetermined length. The plurality of substrate units 600 are prepared, and may be attached on the ridge portions 220 and spaced apart from each other with the furrow portions 210 interposed therebetween.

The interval between the ridge portions 220 may be about 1 to about 10 cm. In other words, the width of the furrow portions 210 may be about 1 to about 10 cm, and thus the interval between the light-emitting devices 100 may also be about 1 to about 10 cm.

As an example, FIG. 2 to FIGS. 5A and 5B, FIGS. 8A to 8C, and FIGS. 9A to C denote multiple array structures, FIGS. 6A and 6B and FIGS. 9E to 9F denote columnar array structures, and FIGS. 8D to 8F denote single array structures.

The light-emitting devices 100 are mounted on the substrate unit 600, and the substrate unit 600 is attached to the heat dissipation unit 200, so that mounting of the light-emitting devices 100 may be implemented. Accordingly, mounting of the light-emitting devices 100 may be further facilitated. A power connection unit 610 connected to an external power source to supply electric power to the light-emitting devices 100 may be prepared on the substrate unit 600, but the configuration of the substrate unit 600 is not limited to this form.

Preferably, a porous heat dissipation composite 700 is applied to at least a portion of the lower surface of the heat dissipation unit 200.

The porous heat dissipation composite 700 has a high emissivity material that has fine porosity and thus has a surface area that is remarkably increased compared to its volume, and there is no limitation on the material. The porous heat dissipation composite 700 is formed on the lower surface of the heat dissipation unit 200, for example, on furrow portions 210 of the lower surface of the heat dissipation unit 200. Since the furrow portions 210 of the lower surface of the heat dissipation unit 200 are formed at positions corresponding to the ridge portions 220 of the upper surface of the heat dissipation unit 200, the porous heat dissipation composite 700 is disposed adjacent to the light-emitting devices 100, and thus heat dissipation effects may be further improved.

In comparison with an LED light fixture with a channel-type heat dissipation system, according to an embodiment of the present disclosure, predetermined comparative examples will be described below.

Figure 10:
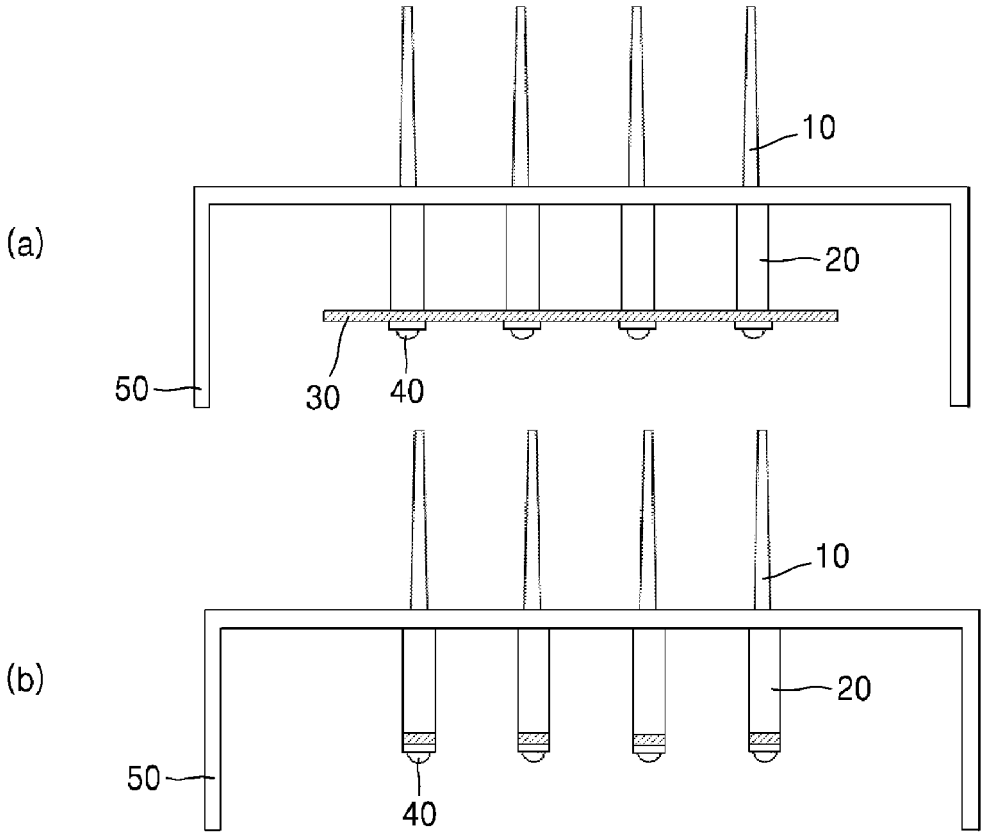
FIG. 10 (Prior Art)
FIGS. 10 to 15 are diagrams of comparative examples of an embodiment of the present disclosure.
Figure 11:
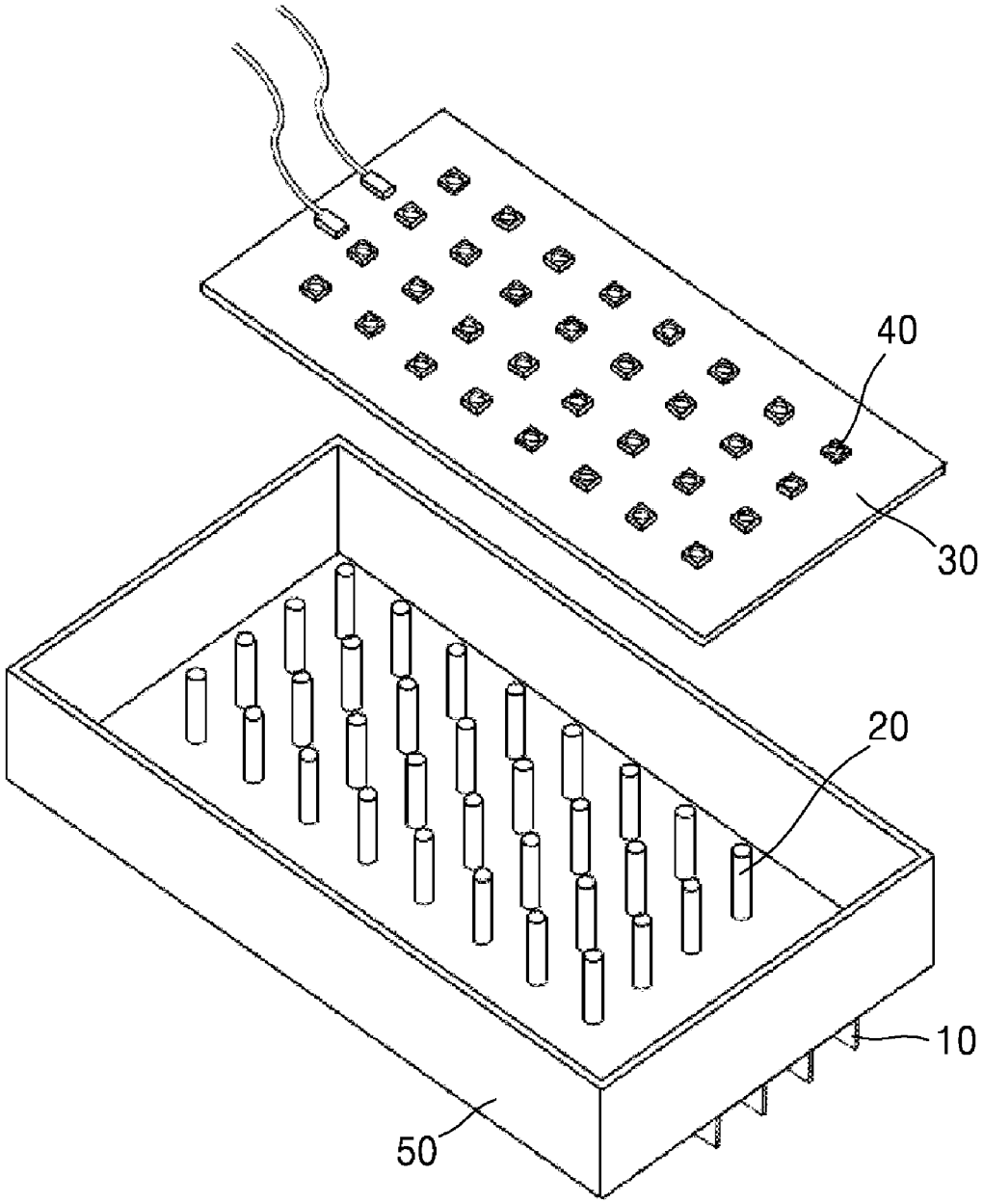
FIG. 11 (Prior Art)

FIGS. 10 and 11 show an LED light fixture as a comparative example that is different from an LED light fixture with a channel-type heat dissipation system, according to an embodiment of the present disclosure.

FIG. 10A is a cross-sectional view of a comparative example of an LED light fixture including a substrate unit 30 having a lower surface on which light-emitting devices 40 are arranged in a multiple array structure, and FIG. 10B is a cross-sectional view of a comparative example of an LED light fixture including a substrate unit 30 having a lower surface on which light-emitting devices 40 are arranged in a single array structure. In these comparative examples, no ventilation channel is prepared. Internal heat dissipation pins 20 having a pin structure are prepared in a casing 50, and external heat dissipation 10 having a fin or plate structure are prepared outside the casing 50.

Figure 12:
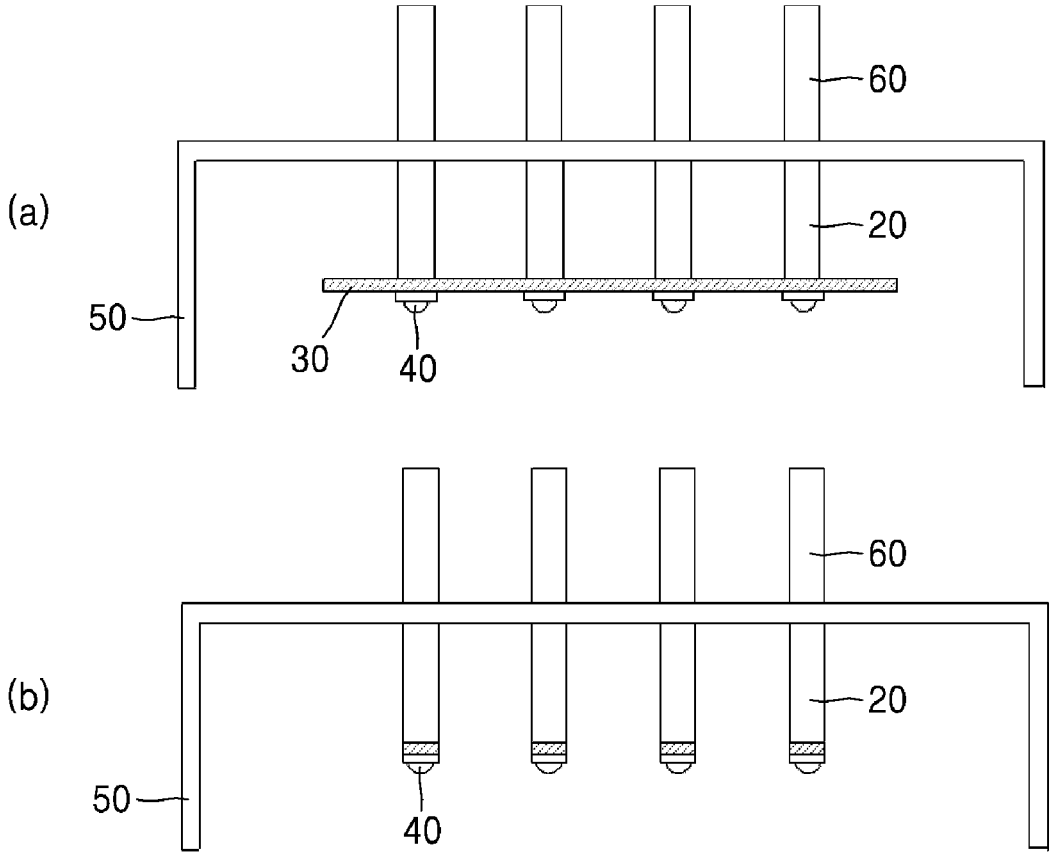
FIG. 12 (Prior Art)
Figure 13:
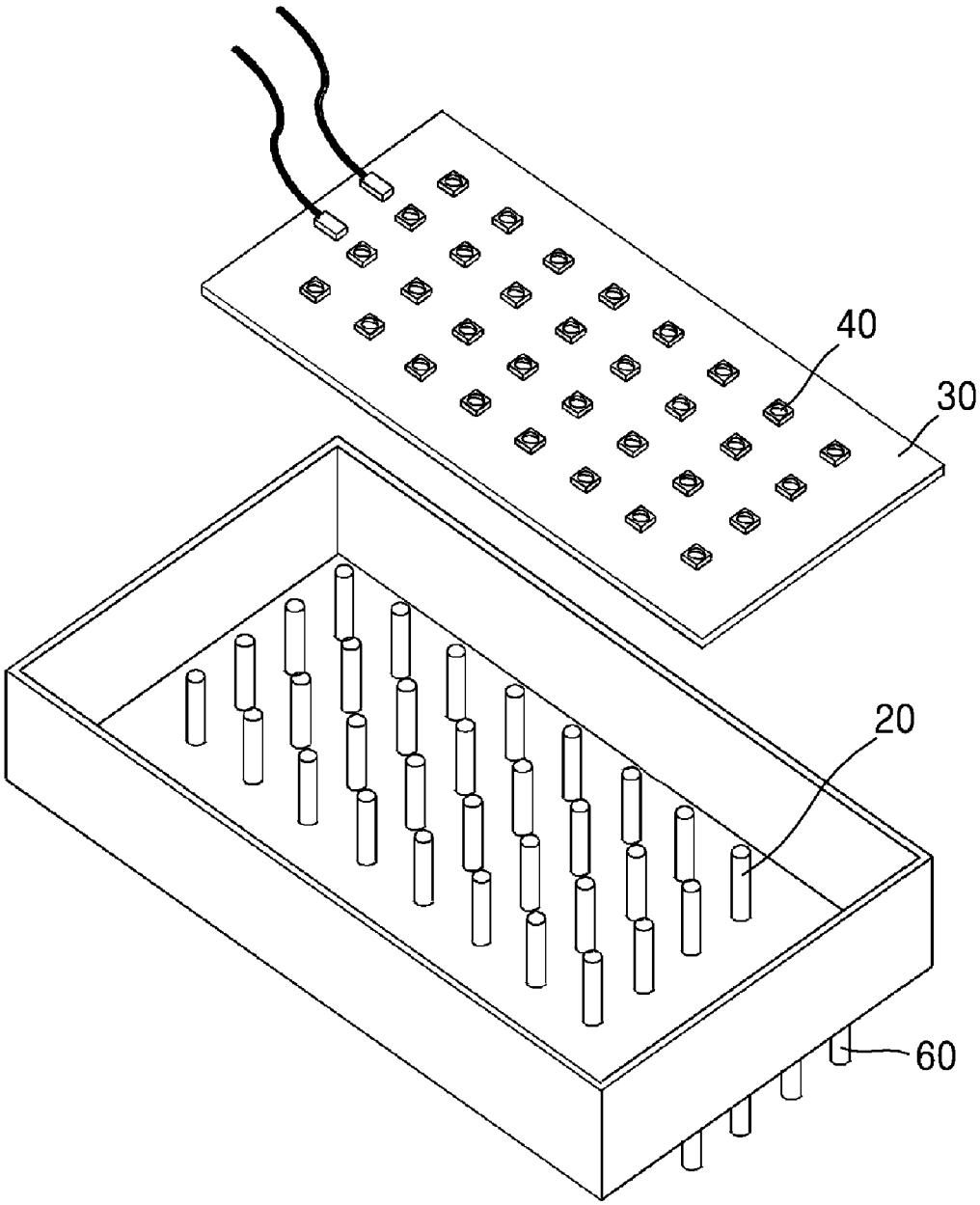
FIG. 13 (Prior Art)

FIGS. 12 and 13 show an LED light fixture as a comparative example that is different from an LED light fixture with a channel-type heat dissipation system, according to an embodiment of the present disclosure.

FIG. 12A is a cross-sectional view of a comparative example of an LED light fixture including a substrate unit 30 having a lower surface on which light-emitting devices 40 are arranged in a multiple array structure, and FIG. 12B is a cross-sectional view of a comparative example of an LED light fixture including a substrate unit 30 having a lower surface on which light-emitting devices 40 are arranged in a single array structure. In these comparative examples, no ventilation channel is prepared. Internal heat dissipation pins 20 having a pin structure are prepared in a casing 50, and external heat dissipation pins 60 having a pin structure are prepared outside the casing 50.

Figure 14:
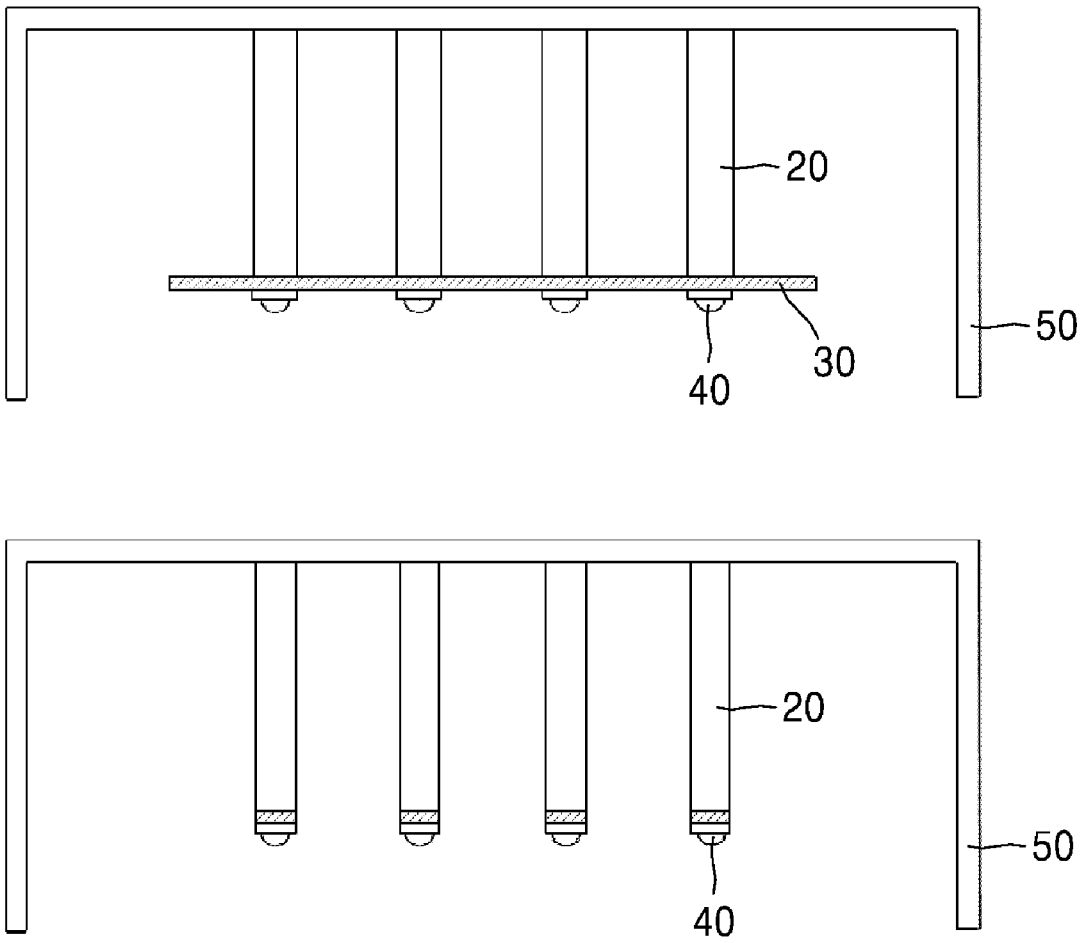
FIG. 14 (Prior Art)
Figure 15:
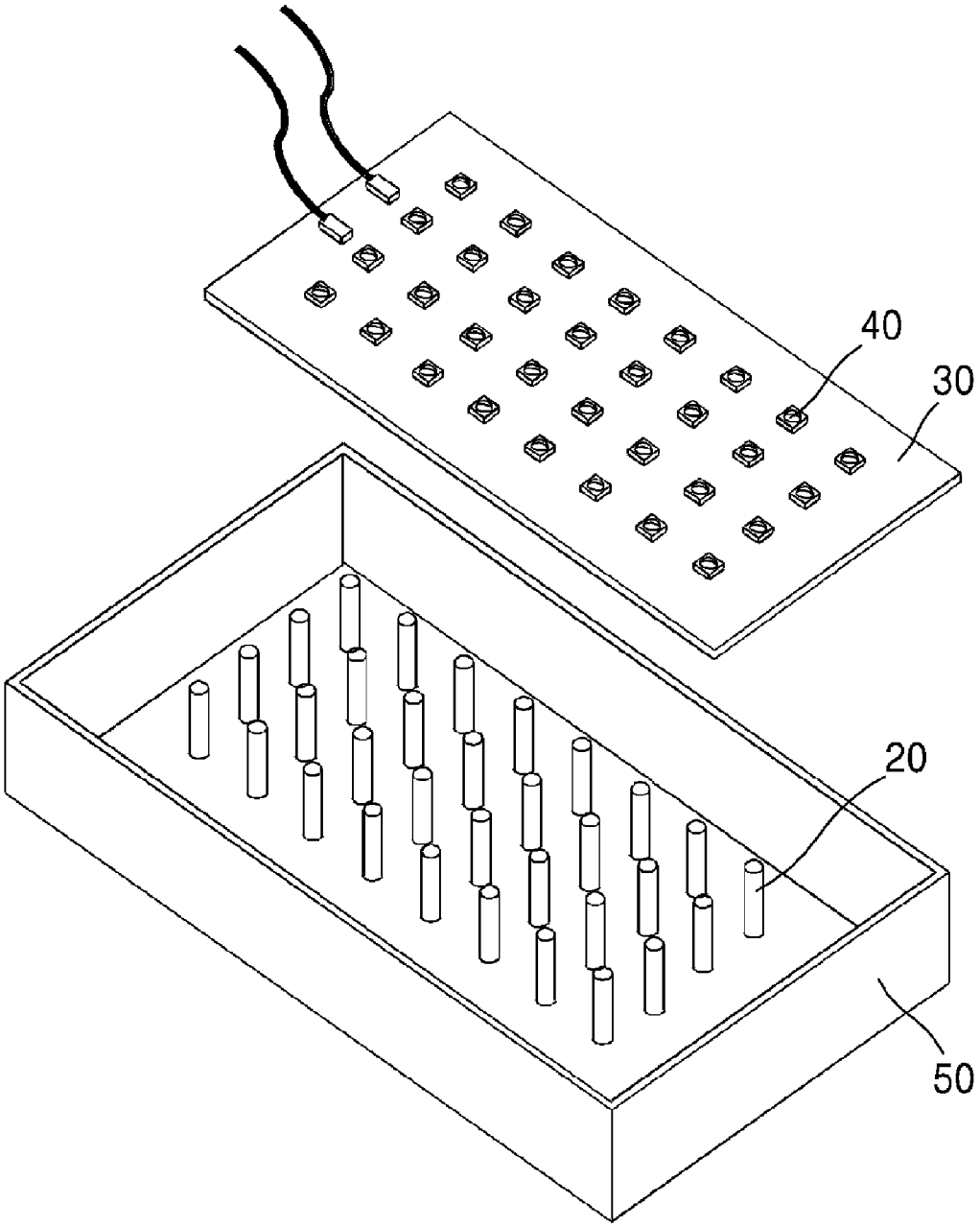
FIG. 15 (Prior Art)

FIGS. 14 and 15 show an LED light fixture as a comparative example that is different from an LED light fixture with a channel-type heat dissipation system, according to an embodiment of the present disclosure.

FIG. 14A is a cross-sectional view of a comparative example of an LED light fixture including a substrate unit 30 having a lower surface on which light-emitting devices 40 are arranged in a multiple array structure, and FIG. 14B is a cross-sectional view of a comparative example of an LED light fixture including a substrate unit 30 having a lower surface on which light-emitting devices 40 are arranged in a single array structure. In these comparative examples, no ventilation channel is prepared. Internal heat dissipation pins 20 having a pin structure are prepared in a casing 50, and no additional heat dissipation structure is prepared outside the casing 50.

The performance of an embodiment of the present disclosure and the above-described comparative examples will be shown in a table below for comparison.

Figure 18:
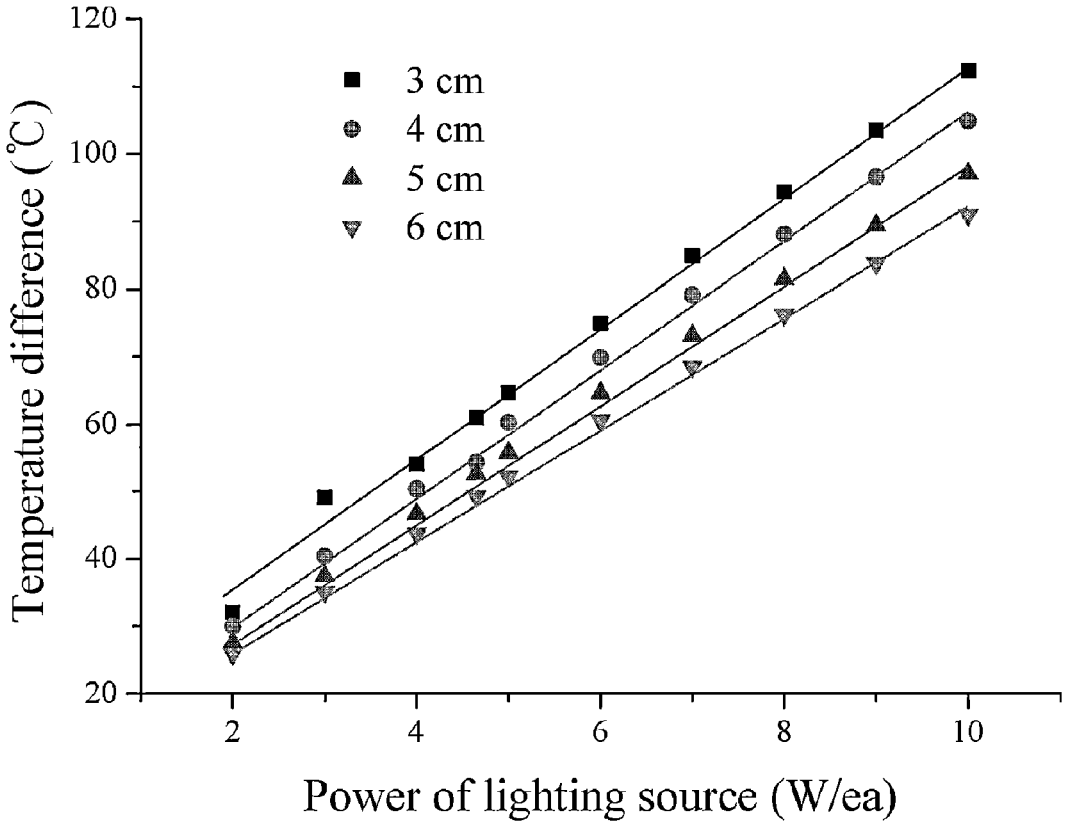

FIGS. 16 to 18 are simulation results showing a change in the total power versus a temperature difference ΔT according to the distance from a light source in an LED light fixture with a channel-type heat dissipation system in which a total of 26 light-emitting devices are arranged in a multiple array structure on a substrate unit at intervals of about 3 cm to about 6 cm. FIGS. 16 to 17 show individual cases as embodiments 1 to 40, and FIG. 18 shows the results in a graph.

FIGS. 16 to 18 show results of simulating a temperature difference ΔT by using a computational fluid dynamics (CFD)-based ANSYS Icepak program when light-emitting devices including a total of 26 LEDs are arranged in a multiple or single array structure in the modules of FIGS. 8C and 8F according to the embodiments 1 to 40 of the present disclosure. Here, the highest junction temperature $T_j$ is not able to be measured, but may be calculated as given below from a relationship of a temperature $T_c$ of a solder point with a thermal resistance $R_{j\text{-}c}$ and a total power loss $P_d$ of the light-emitting devices by measuring the temperature $T_c$.

$$T_c=T_j-(R_{j\text{-}c}\times P_d)$$

The thermal resistances of packages are slightly different according to package types, but are generally about 2.5° C./W to 2.6° C./W. Also, power loss is about 80% of power. When an outdoor temperature is $T_a$, the thermal resistance of a thermal interface material (TIM) or a gap filler between an LED package and a PCB substrate, and/or between a PCB and a heat sink is $R_b$, and the thermal resistance of a heat sink is $R_h$, the following relationship is obtained:

$$(T_j-T_a)=\Delta T=(R_{j\text{-}c}+R_b+R_h)P_d=R_T\times P_d$$

Here, $R_T$ is a total thermal resistance, and $P_d$ is a product of power P and a loss rate L. And here, the TIM or gap filler is intended to reduce contact thermal resistance between an LED package and a printed circuit board (PCB) substrate, or between a PCB and a heat sink, and used as thermally conductive materials in the form of paste, grease, and tape. Therefore, ΔT is expressed as follows:

$$\Delta T\propto((R_T+L)P$$

It is possible to know that ΔT is linearly in proportion to the power P. FIG. 18 shows the results of FIG. 17, that is, a change in ΔT versus power when the interval between the light-emitting devices varies, and it is possible to see that ΔT is linearly in proportion to power according to intervals. Also, it is possible to know that the total thermal resistance (slope) is slightly reduced as the interval increases.

FIGS. 19 and 20 are simulation results showing a change in ΔT according to the height of a ventilation channel when the intervals between light-emitting devices are uniformly fixed to 4 cm and a heat dissipation unit is formed of 99% or more aluminum having a thermal conductivity of 205 W/mK or die-casting aluminum having a thermal conductivity of 100 W/mK in LED light fixtures with channel-type heat dissipation systems having total output powers of 120 W and 150 W. FIGS. 19 to 20 show individual cases as embodiments 41 to 60, and FIG. 21 shows the results in a graph.

Figure 21:
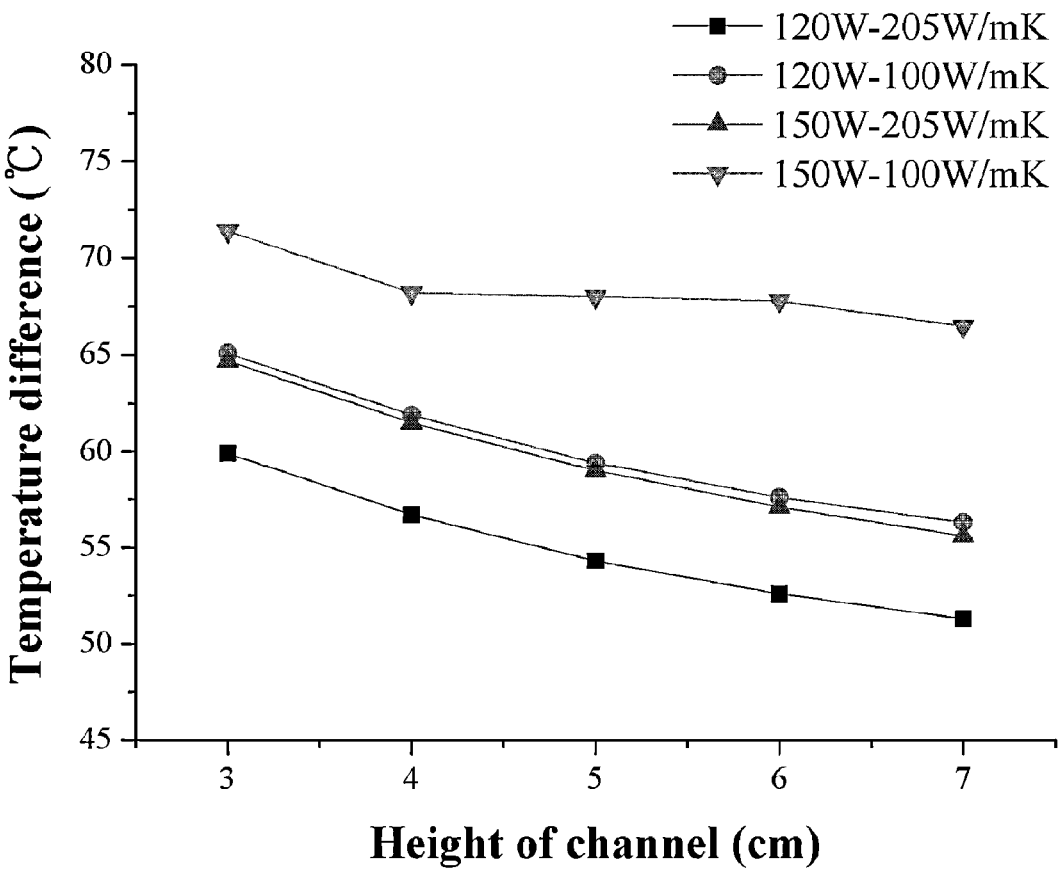

From the results shown in FIG. 21, it is possible to see that ΔT tends to gradually decrease at 120 W and 150 W when the height of a channel increases, but the amount of reduction significantly decreases at 5 cm or more. In particular, it is possible to know that, when die-casting aluminum is used for a 150-W LED light fixture, the die-casting aluminum shows a poorer heat dissipation characteristic than aluminum having a double thermal conductivity, and heat dissipation effects are almost not improved even if the height increases more than 4 cm.

Figure 24:
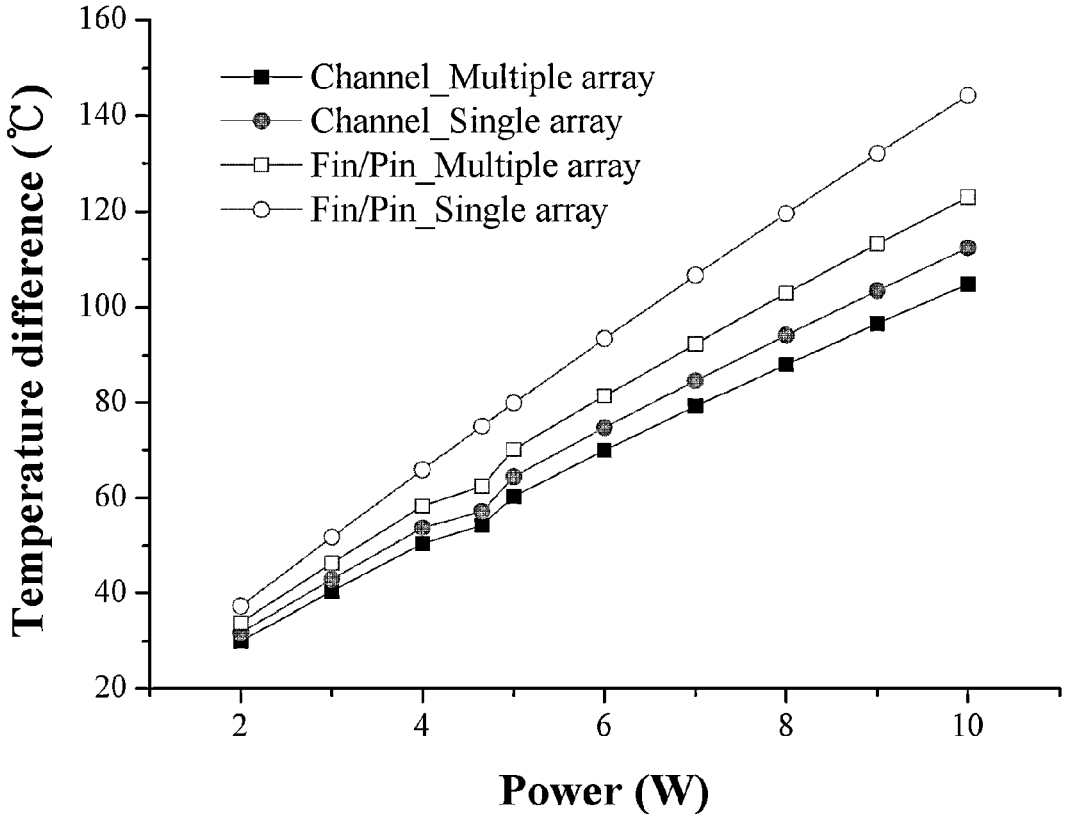

FIGS. 22 and 23 are simulation results showing a change in ΔT when 4.65-W LED light sources are arranged to be 120 W in multiple and single array structures at intervals of 4 cm in LED light fixtures with channel-type heat dissipation systems having heat dissipation structures that have the ventilation channel structures of FIGS. 8C and 8F, and in LED light fixtures with 205-W/mK aluminum heat dissipation systems having the heat dissipation plate (or fin)/heat dissipation pin combination structures of FIG. 10. FIG. 22 show individual cases of the ventilation channel structures of FIGS. 8C and 8F as embodiments 61 to 80, and individual cases of the heat dissipation plate/heat dissipation plate combination structures of FIG. 10 as comparative examples 1 to 20. FIG. 24 shows the results in a graph.

FIGS. 22 and 23 are in accordance with the embodiments 61 to 80 of the present disclosure and comparative examples 1 to 20. According to the embodiments 61 to 70, 4.65-W LED light sources are arranged to be 120 W in a multiple array structure at intervals of 4 cm in a heat dissipation system having the channel structure of FIG. 8C (height of 5 cm), and according to the embodiments 71 to 80, LEDs are arranged in a single array structure in a heat dissipation system having the channel structure of FIG. 8F. According to the comparative examples 1 to 10, 5-W LED light sources are arranged to be 120 W in a multiple array structure at intervals of 4 cm in a heat dissipation system having the heat dissipation plate/heat dissipation pin combination structure of FIG. 10A (height of 5 cm), and according to the comparative examples 11 to 20, 5-W LED light sources are arranged in a single array structure under the same condition as FIG. 10A in a heat dissipation system having the heat dissipation plate/heat dissipation pin combination structure of FIG. 10B. As shown in FIG. 24, in all the light fixtures having the multiple and single array structures, embodiments having the channel structures show much better heat dissipation effects than comparative examples having the plate/pin-shaped structures. In particular, it is possible to know that the total thermal resistance $R_T$ is low in the channel structures.

Figure 27:
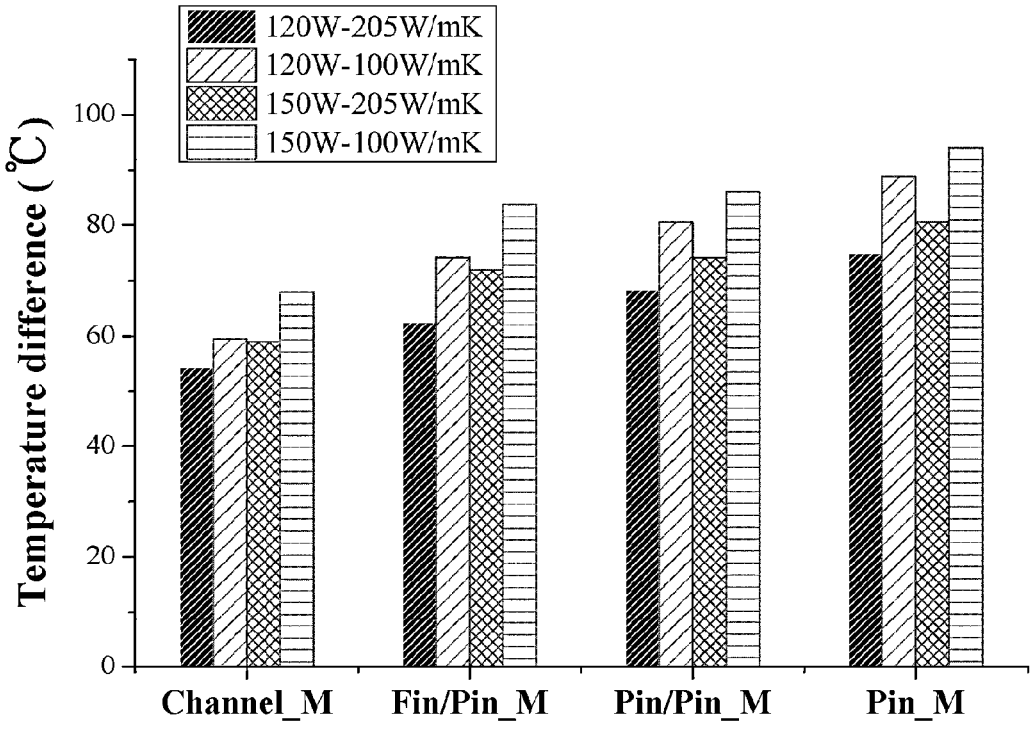

FIGS. 25 and 26 are simulation results showing a change in ΔT when light sources are arranged in a multiple array structure at intervals of 4 cm in LED light fixtures with channel-type heat dissipation systems having 205-W/mK aluminum heat dissipation systems that have the channel structures of FIGS. 7C and 7F (embodiments 81, 83, 85, and 87), the heat dissipation plate/heat dissipation pin combination structure of FIGS. 10 and 11 (comparative examples 21, 27, 33, and 39), the heat dissipation pin/heat dissipation pin structure of FIG. 12 (comparative examples 22, 28, 34, and 40), and the heat dissipation pin structure of FIG. 13 (comparative examples 23, 29, 35, and 41) as heat dissipation structures. FIG. 27 shows the results in a graph.

In addition, embodiments 89 to 92 of FIGS. 25 and 26 are simulation results showing a change in ΔT when light sources are arranged in a columnar array structure at intervals of 4 cm in an LED light fixture with a channel-type heat dissipation system having the heat dissipation system of a channel structure having bidirectional air flow paths shown in FIG. 6.

Figure 28:
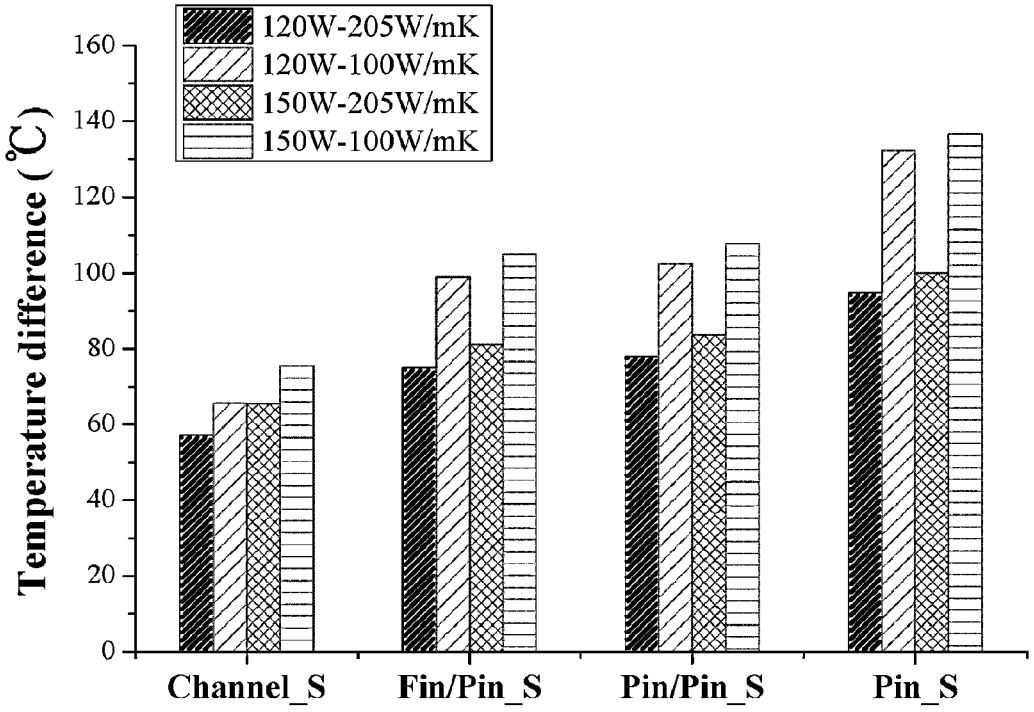

FIGS. 25 and 26 are simulation results showing a change in ΔT when light sources are arranged in a single array structure at intervals of 4 cm in LED light fixtures with channel-type heat dissipation systems having 205-W/mK aluminum heat dissipation systems that have the ventilation channel structures of FIGS. 7C and 7F (embodiments 82, 84, 86, and 88), the heat dissipation plate (or fin)/heat dissipation pin combination structure of FIG. 10 (comparative examples 24, 30, 36, and 42), the heat dissipation pin/heat dissipation pin structure of FIG. 12 (comparative examples 25, 31, 37, and 43), and the heat dissipation pin structure of FIG. 14 (comparative examples 26, 32, 38, and 44) as heat dissipation structures. FIG. 28 shows the results in a graph.

Figure 29:
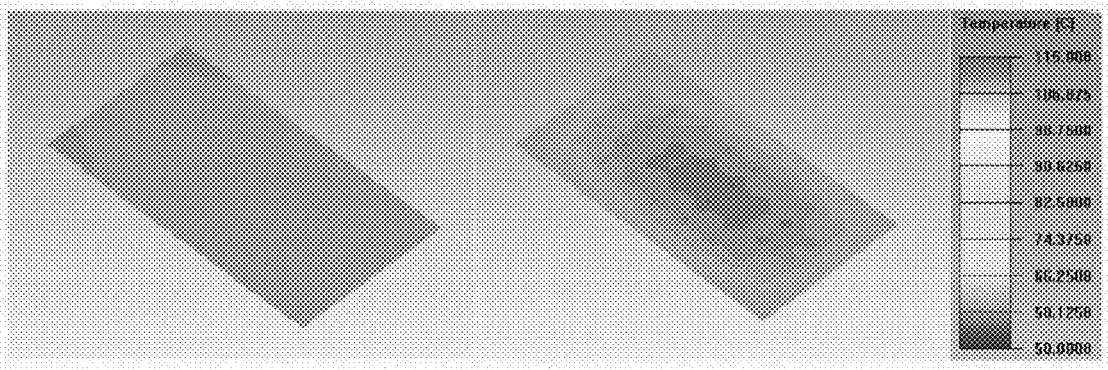

FIG. 29 is in accordance with the embodiment 87 of the present disclosure and the comparative example 41 shown in FIGS. 25 and 26, and shows heat distribution when light sources are arranged in a multiple array structure at intervals of 4 cm in LED light fixtures having 100-W/mK aluminum heat dissipation systems having a ventilation channel structure and a heat dissipation pin structure as heat dissipation structures.

As shown in FIGS. 27 and 28, it is possible to see that heat dissipation occurs in a light fixture having a channel structure according to an embodiment of the present disclosure much more effectively than in a light fixture of a comparative example including various heat dissipation structures of heat dissipation pins or heat dissipation fins. From heat dissipation results shown in the heat distribution of FIG. 29 for comparison between the embodiment 87 of the present disclosure in which light sources are arranged in a multiple array structure at intervals of 4 cm in an LED light fixture having a 100-W/mK aluminum heat dissipation system including a channel structure and the comparative example 41 of the heat dissipation fin structure, it is possible to see that the channel structure shows a much better heat dissipation characteristic than the heat dissipation fin structure of the comparative example.

As described above, according to the one or more of the above embodiments of the present disclosure, an LED light fixture includes a heat dissipation unit having ridge portions and furrow portions, and a casing having vent holes. Since the ridge portions and the furrow portions formed in the heat dissipation unit and the vent holes formed in the casing constitute a ventilation channel, the flow of air is promoted to facilitate dissipation of heat generated from light-emitting devices, and heat transfer and radiation efficiency is increased as much as possible. Also, by reducing the volume and the weight of a heat dissipation body, it is possible to configure the LED light fixture with a channel-type heat dissipation system to have improved heat dissipation efficiency and a compact structure.

The ventilation channel includes the ridge portions and the furrow portions of the heat dissipation unit, and thus the heat dissipation area of the heat dissipation unit increases. Accordingly, a contact area between ambient air and the heat dissipation unit increases, that is, heat exchange efficiency increases, and the heat dissipation efficiency of the LED light fixture may be further improved.

Since the vent holes are formed at both ends of directions in which the ridge portions and the furrow portions extend, ambient air flowing in the ridge portions and the furrow portions through vent holes on one side may flow in the directions in which the ridge portions and the furrow portions extend and may flow out through vent holes on the opposite side. In other words, the ridge portions and the furrow portions serve as air flow paths to promote the flow of air in various directions, and cooling and heat dissipation of the LED light fixture may be achieved more efficiently according to the flow of air.

The light-emitting devices may be mounted on a substrate unit, and the substrate unit may be attached to the heat dissipation unit. Accordingly, the light-emitting devices may be mounted further simply.

A porous heat dissipation composite body is formed on the lower surface of the heat dissipation unit, for example, in the furrow portions of the lower surface of the heat dissipation unit. In other words, the porous heat dissipation composite body is disposed adjacent to the light-emitting devices, and thus heat dissipation effects may be further improved.

It should be understood that the exemplary embodiments described therein should be considered in a descriptive sense only and not for purposes of limitation. Descriptions of features or aspects within each embodiment should typically be considered as available for other similar features or aspects in other embodiments.

While one or more embodiments of the present disclosure have been described with reference to the figures, it will be understood by those of ordinary skill in the art that various changes in form and details may be made therein without departing from the spirit and scope of the present disclosure as defined by the following claims.

What is claimed is:

1. A light-emitting diode (LED) light fixture with a channel-type heat dissipation system, the LED light fixture comprising:

a substrate unit;

a power connection unit attached to the substrate unit;

a plurality of LEDs attached to the substrate unit and coupled to the power connecting unit;

a heat dissipation unit bent a plurality of times and having a plurality of ridge portions and a plurality of furrow portions, wherein the substrate unit is mounted on the ridge portions;

a casing attached to the heat dissipation unit wherein the casing having a plurality of vent holes;

a cover connected with the casing, such that the cover is disposed above the LEDs;

a gasket between the cover and the casing; and a ventilation channel between the casing and the heat dissipation unit which provides an air flow path between the vent holes of the casing and the furrow portions of the heat dissipation unit, wherein the furrow portions comprise a plurality of first furrow portions extending in parallel with each other and a plurality of second furrow portions extending in parallel with each other, wherein the first furrow portions and the second furrow portions are perpendicular to each other, each of the furrow portions has a rounded bottom edge, the furrow portion in the middle of the heat dissipation unit is deeper than the furrow portion at an outer side of the heat dissipation unit, and a lower surface of the heat dissipation unit is coated with a porous heat-dissipation complex.

2. The LED light fixture of claim 1, wherein the substrate unit is plural in number.

3. The LED light fixture of claim 1, wherein the casing is in a form of a hexahedron with a rectangular horizontal cross-section and a rectangular longitudinal cross-section.

4. The LED light fixture of claim 1, wherein the casing has a form of an ellipse, and is curved to have a dome shape.

* * * * *